US009468831B2

(12) United States Patent
Brantingham

(10) Patent No.: US 9,468,831 B2
(45) **Date of Patent: *Oct. 18, 2016**

(54) GOLF SWING APPARATUS

(71) Applicant: David E. Brantingham, Taipei (TW)

(72) Inventor: David E. Brantingham, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/609,917

(22) Filed: Jan. 30, 2015

(65) Prior Publication Data

US 2015/0157915 A1 Jun. 11, 2015

Related U.S. Application Data

(63) Continuation-in-part of application No. 13/369,636, filed on Feb. 9, 2012, now Pat. No. 8,986,128, which is a continuation-in-part of application No. 12/815,664, filed on Jun. 15, 2010, now Pat. No. 8,137,207.

(51) Int. Cl.

| | |
|---|---|
| ***A63B 69/36*** | (2006.01) |
| ***A63B 71/06*** | (2006.01) |
| ***A63B 24/00*** | (2006.01) |
| ***A63B 69/00*** | (2006.01) |
| *A63B 71/02* | (2006.01) |

(52) U.S. Cl.

CPC ..... *A63B 69/3655* (2013.01); *A63B 24/0021* (2013.01); *A63B 69/0079* (2013.01); *A63B 69/3623* (2013.01); *A63B 71/0619* (2013.01); *A63B 2024/0031* (2013.01); *A63B 2071/026* (2013.01); *A63B 2209/08* (2013.01); *A63B 2220/18* (2013.01); *A63B 2220/34* (2013.01); *A63B 2220/805* (2013.01); *A63B 2225/50* (2013.01)

(58) Field of Classification Search

USPC ..... 473/138–150, 157–163, 167, 168, 171, 473/278, 279

See application file for complete search history.

(56) References Cited

U.S. PATENT DOCUMENTS

| | | | | |
|---|---|---|---|---|
| 1,363,446 | A | 12/1920 | Vogel | |
| 2,656,720 | A | 10/1953 | Sonnett | |
| 3,658,343 | A | 4/1972 | Rogers et al. | |
| 3,690,673 | A | 9/1972 | Occhipinti | |
| 4,240,637 | A * | 12/1980 | Cross | A63B 67/02 473/160 |
| 4,327,918 | A | 5/1982 | Foster | |
| 4,343,469 | A | 8/1982 | Kunita et al. | |
| 4,437,672 | A | 3/1984 | Armantrout et al. | |
| 4,451,043 | A | 5/1984 | Ogawa et al. | |
| 4,958,836 | A | 9/1990 | Onozuka et al. | |
| 5,056,791 | A | 10/1991 | Poillon et al. | |
| 5,121,923 | A | 6/1992 | D'Allura | |
| 5,165,691 | A | 11/1992 | Cook | |
| 5,172,914 | A | 12/1992 | Primerano | |
| 5,217,228 | A | 6/1993 | De Aguilar | |
| D353,179 | S | 12/1994 | Pittman | |
| 5,413,345 | A | 5/1995 | Nauck | |
| 5,435,562 | A | 7/1995 | Stock et al. | |
| 5,437,457 | A | 8/1995 | Curchod | |

(Continued)

*Primary Examiner* — Nini Legesse

(74) *Attorney, Agent, or Firm* — Wagenknecht IP Law Group PC

(57) ABSTRACT

A golf swing apparatus including a rotating drum that houses a swivel and an optical sensor to detecting a change in swivel angle; an elongated cord hanging from the drum and secured to a golf ball; a base member having an impact layer that is switchable between two orientations, the first being planar and the second being raised to stop or slow a rotating golf ball; a frame holding the rotating drum over the impact layer; a means for measuring rotation speed of the rotating drum; and a processor for generating swing data.

17 Claims, 30 Drawing Sheets

(56) References Cited

U.S. PATENT DOCUMENTS

| | | | | |
|---|---|---|---|---|
| 5,460,380 | A | 10/1995 | Ober | |
| 5,733,200 | A * | 3/1998 | Kim | A63B 67/02 473/153 |
| 5,855,522 | A * | 1/1999 | Bevan | A63B 67/02 473/160 |
| 6,056,645 | A | 5/2000 | Servatius | |
| 6,059,668 | A | 5/2000 | Marley, Jr. | |
| 6,257,989 | B1 | 7/2001 | Tortola | |
| 6,338,682 | B1 | 1/2002 | Torchia et al. | |
| 6,458,038 | B1 | 10/2002 | Lin | |
| 6,569,026 | B1 | 5/2003 | Weis | |
| D500,544 | S | 1/2005 | Wu | |
| 6,872,150 | B2 | 3/2005 | Welch | |
| 7,214,136 | B1 | 5/2007 | Perry | |
| 7,513,840 | B2 * | 4/2009 | Latella, Jr. | A63B 15/00 473/219 |
| 8,137,207 | B2 | 3/2012 | Brantingham | |
| 8,986,128 | B2 * | 3/2015 | Brantingham | A63B 69/0079 139/279 |
| 2005/0107179 | A1 | 5/2005 | Munshi | |
| 2007/0191128 | A1 | 8/2007 | Tirol | |
| 2007/0224583 | A1 | 9/2007 | Humphrey | |
| 2009/0215548 | A1 | 8/2009 | Broering | |
| 2012/0142442 | A1 | 6/2012 | Brantingham | |

* cited by examiner

GOLF SWING APPARATUS

CROSS-REFERENCE TO RELATED APPLICATIONS

This is a continuation-in-part of U.S. patent application Ser. No. 13/369,636, filed Feb. 9, 2012, now U.S. Pat. No. 8,986,128, which itself a continuation-in-part of U.S. patent application Ser. No. 12/815,664, filed Jun. 15, 2010, now U.S. Pat. No. 8,137,207; the content of each is herein incorporated by reference in its entirety.

TECHNICAL FIELD

The present invention relates generally to a golf swing apparatus and more specifically to a golf swing apparatus including a rotating drum that houses a swivel and sensor that detect the trajectory of a struck golf ball, and a base member that stops rotation of the golf ball after being struck.

BACKGROUND OF THE INVENTION

The game of golf is played on a golf course which usually has eighteen holes. Each hole is positioned on a green a selected distance from a tee-box. A golfer initially hits the ball towards the green then ultimately into the hole. In order to reach the green, the golfer employs clubs, either woods or irons, which have different lifts and weights so that the ball flies a calculated distance. Once on the green, the golfer uses a putter to roll the ball until it is ultimately hit into the hole.

It is well known that a golfer's game can be improved by practicing hitting golf balls. While it is comparatively easy to practice putting, it is more difficult practicing longer golf shots, such as those that would occur from the tee-box or fairway to the green. Accordingly, practicing long distance hitting or driving is most frequently done at driving ranges. However, driving ranges can be time-consuming, expensive and inconvenient. Additionally, since driving ranges are located outdoors, bad weather may prevent their use.

In light of these difficulties, several golf swing devices have been developed for use in a confined area. Such devices include tethered golf ball trainers, laser alignment club trainers, catch nets, and sensor-driven computer simulation systems.

Examples of tethered golf ball trainers can be found in U.S. Pat. No. 2,656,720, U.S. Pat. No. 4,958,836, U.S. Pat. No. 5,460,380, US 2005/0107179, D353,179 and D500,544. Tethered trainers provide the opportunity to use a normal golf club to practice swinging at a golf ball. However, their tether and frame structures often cannot withstand the forces associated with club impact at club head speeds above 70 miles per hour. The club head speed of an average golfer's swing is approximately 80 to 95 miles per hour. The speed of an average touring professional golfer's swing is approximately 110 to 125 miles per hour. Additionally, missed swings striking the tether cord may result in lassoing of the tether cord around the golf club head, which can damage the golf club.

Examples of laser alignment club trainers can be found in U.S. Pat. No. 5,165,691, U.S. Pat. No. 5,217,228, U.S. Pat. No. 5,435,562, U.S. Pat. No. 6,059,668, U.S. Pat. No. 6,458,038, U.S. Pat. No. 6,872,150 and US 2009/0215548. Laser alignment club trainers allow a user to visualize the theoretical path of a golf ball based on the orientation of golf club head. However, such trainers require special golf clubs with lasers mounted on or in the shaft or club head.

Sensor-driven computer simulation systems and catch nets are provided by U.S. Pat. No. 4,327,918, U.S. Pat. No. 4,343,469, U.S. Pat. No. 4,437,672, U.S. Pat. No. 4,451,043, U.S. Pat. No. 5,056,791, U.S. Pat. No. 5,437,457 and US 2007/0224583. Sensor-driven computer simulation systems simulate real play by employing a series of optical sensors which gather information about a swing, computing the theoretical path of the golf ball using such information, and displaying the path to a user. However, simulation systems and catch nets are expensive, difficult to install, and require a large space. Additionally, systems employing catch nets require a user to fetch the ball and reset it after each swing.

Accordingly there continues to be a need for new and improved golf swing apparatuses that can safely accommodate swings at club head speeds in excess of 70 miles per hour without employing large catch nets or expensive sensor driven computer simulation systems.

SUMMARY OF THE INVENTION

The invention addresses deficiencies inherent to current golf swing devices and provides related benefits. This is accomplished at least in part through a golf swing apparatus, which includes a rotating drum that houses a swivel attached to a golf ball and a sensor, where the sensor detects a change in swivel position or angle. After ball strike the base stops the rotating ball to set another practice shot. In one embodiment, golf swing practice apparatus includes a rotating drum housing a swivel and sensor, where the swivel rotates in a direction perpendicular to the rotational direction of the drum and the sensor detects a change in swivel angle; an elongated cord including a proximal end secured to the drum and a distal end secured to a golf ball; a base member having an impact layer over which a user may swing a golf club when in a first orientation and a second orientation that stops or slows rotation of the golf ball; a frame structure holding the rotating drum in an elevated position above the impact layer and providing an axis for the rotational direction; a means for measuring rotation speed of the rotating drum; and a processor operably connected to the sensor and the means for measuring rotation speed for generating swing data.

Preferably, the sensor is an optical sensor that detects change in swivel angle by optically detecting movement across an inner surface of the rotating drum. Movement can be detected or tracked by projecting a laser beam against the interior portion of the drum, such as along a reflective slot, and monitoring change in position along the drum as the drum rotates. In another approach, the optical sensor detects change in swivel angle by projecting a laser beam against the swivel and monitoring change in position along the swivel. Data from the sensor is preferably wirelessly transmitted to the processor, which may be housed within a consol.

Rotational speed of the drum or ball can be performed by securing a magnet to the rotating drum; and providing a magnet sensor secured to the frame, where the magnet sensor monitors the rotational passage of the magnet. Alternative approaches can also be incorporated such as a light beam source crossing a light detector for counting or modulation of a current upon rotation of a metallic or interfering object.

By communicating with the both the sensor and means for measuring rotation, the processor calculates a variety of useful swing data. In some embodiments the processor determines an approximate angle at which the ball left a user's club head. In some embodiments the processor computes a theoretical spatial location relative to a simulated fairway to which the golf ball would travel. In some embodiments the processor determines one or more selected from the group consisting of predicted distance, club head speed, and degree off center. When the processor is provided in a consol, swing data from the processor can be transferred to a viewing screen also forming part of the consol. In other embodiments, swing data is transferred wirelessly to a mobile device, such as a mobile phone or tablet computer. Such mobile phones or tablet computers may be loaded with software to receive and/or display the swing data. In some embodiments the consol is a tablet computer or mobile phone loaded with suitable software. In some embodiments swing data is maintained in a memory database to permit tracking or comparison to other swing data. In some embodiments, the base member includes a series of light emitting diodes (LEDs) that display swing data by selectively lighting at least one LED corresponding to rotational speed or swivel angle.

Stopping rotation of the ball is accomplished by configuring the impact layer to switch between two orientations. A first orientation is planar to provide a flat surface for impacting a golf club during a golf swing and a second orientation is raised across a width of the impact layer and perpendicular to the rotational direction of the drum to stop or slow a rotating golf ball after impact. Preferably the impact layer slides relative to the bottom layer when switching between the two orientations. In some embodiments the means for raising the impact layer includes a motor coupled to a rotatable paddle that raises the impact layer to the second orientation. Rotation can be clockwise or counter clockwise. In further embodiments the bottom layer includes a recess for receiving the paddle when the impact layer is in the first orientation. In other embodiments the means for raising the impact layer includes a motor coupled to cables or rods for pulling the impact layer to the second orientation, which is raised. Springs or elastic bands may also be included to return the impact layer from the second orientation to the first orientation upon tension release by the motor. Alternatively or in addition the motor can return the impact layer to its first orientation by rotating the paddle in the opposite direction or pushing a rod connected to the impact layer.

In a related aspect of the invention a base member for use with a golf swing apparatus is provided having an impact layer lying over a bottom layer, where the impact layer is switchable between two orientations, namely, a first orientation generally planar to provide a flat surface for impacting a golf club during a golf swing and a second orientation raised across a width of the impact layer to stop or slow a rotating golf ball after impact. In preferred embodiments the entire width of the impact layer is raised to stop or slow the rotating ball. In other embodiments the raised width is less than the entire width and defined by an impact area cut from the impact layer.

In some embodiments, the means for raising the impact layer includes a paddle underneath the impact layer. Preferably the paddle is rotated upward by a motor having gearing for rotation, such as a servo motor. In some embodiments the motor is coupled to the paddle underneath the impact layer. Preferably the paddle extends more than 50% of the width of the impact layer. Preferably the paddle is recessed within the bottom layer in the first orientation and rotates to project above the bottom layer in the second orientation, such as at an angle of 90 degrees+/− about 30 degrees from the plane of the bottom layer. The impact layer permits the paddle to rotate by providing one end secured to the bottom layer and the opposing end unsecured from the bottom layer thereby permitting the unsecured end to slide along the bottom layer creating a bulge. In a related embodiment, the means for raising the impact layer includes a motor with a pulling cable, which pulls an unsecured end of the impact layer towards a secured end causing the impact layer to bulge and thus rise into the path of the rotating golf ball.

BRIEF DESCRIPTION OF THE DRAWINGS

Embodiments of the invention can be better understood with reference to the following drawings, which are part of the specification and represent preferred embodiments. The components in the drawings are not necessarily to scale, emphasis instead being placed upon illustrating the principles of the invention. And, in the drawings, like reference numerals designate corresponding parts throughout the several views.

DETAILED DESCRIPTION OF PREFERRED EMBODIMENTS

Figure 1:
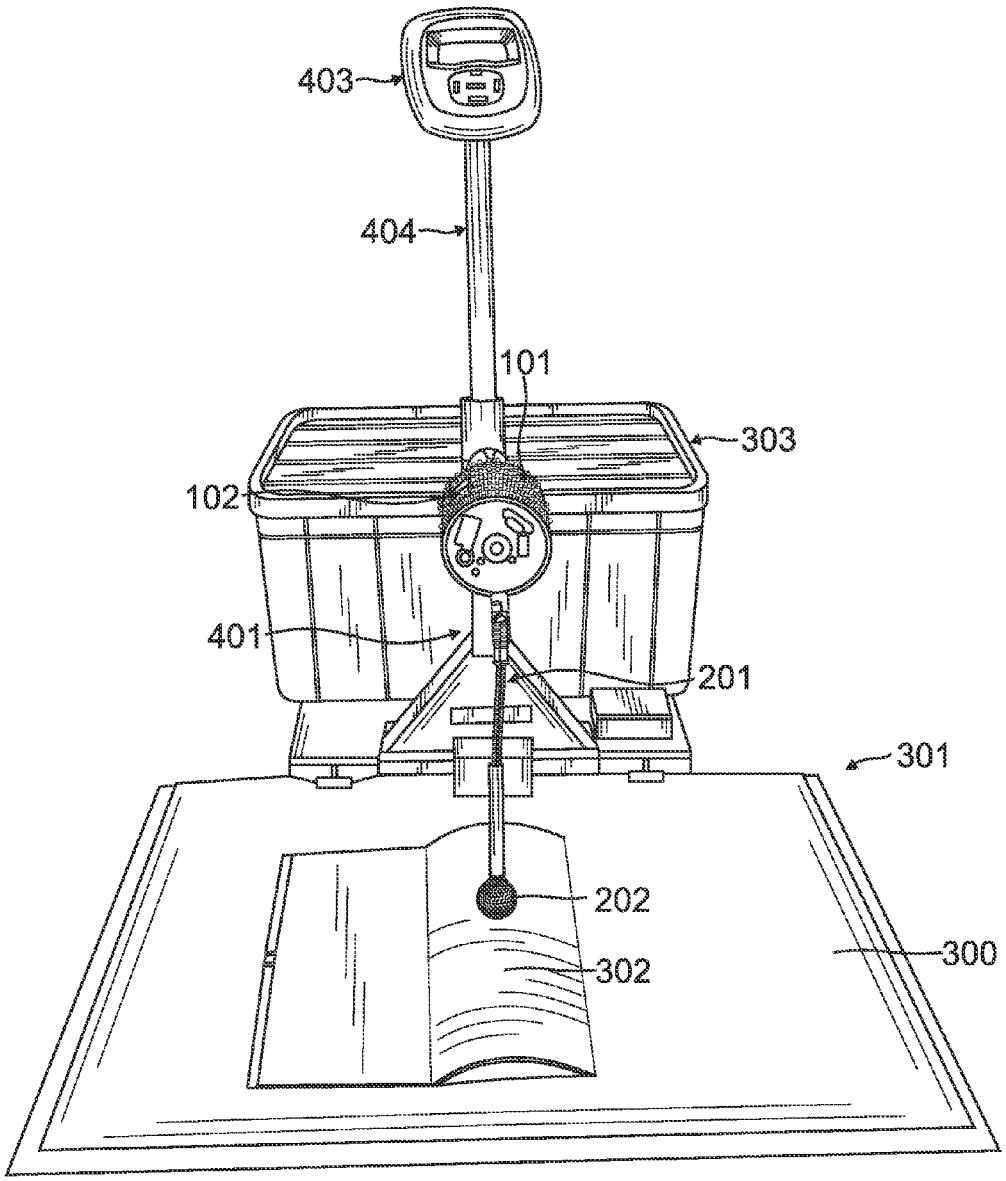
FIG. 1 is a front perspective view of an embodiment of a golf swing apparatus including a laser generating means 102 for visually monitoring the path of a golf ball 202.

The invention provides a golf swing apparatus that determines speed and a trajectory of a struck golf ball. This is accomplished in part through the use of a rotating drum that houses a swivel attached to a golf ball. In one embodiment, the rotating drum includes a plurality of lasers that project light outward and thus permits the user to visually determine whether the ball trajectory is straight, left of center, or right of center by visually monitoring the projected light beams. In a second embodiment, the rotating drum includes an internal sensor, which detects a change in swivel angle, which corresponds to theoretical ball trajectory. Thus, the sensor detects left or right movement of the tethered ball and thus monitors whether the ball trajectory is straight, left of center, or right of center. In this approach, ball trajectory data can be combined with rotational velocity or force measurement to determine a variety of useful swing data including club head speed, distance off center and a theoretical spatial location relative to a simulated fairway to which the golf ball would travel. Such calculations are performed by communication with a processor and can be shown on a display, which may be integrated into the apparatus itself or may be wirelessly transmitted to a mobile device such as a mobile phone or tablet computer loaded with appropriate software. Measurement of predicted ball speed is accomplished by rotational measurement of the drum. Further, the apparatus provides a mechanism that raises a portion of the base to stop a rotating ball after data is collected to prepare for another shot. The mechanism can be initiated immediately by the apparatus after ball strike or can be delayed.

For clarity of disclosure, and not by way of limitation, the invention is discussed according to different detailed embodiments; however, the skilled artisan would recognize that features of one embodiment can be combined with other embodiments, such as different combinations of drums, base members, and processors and is therefore well within the intended scope of the invention.

Referring generally to FIGS. 1, 2, 19, and 20, the golf swing apparatus includes a rotating drum 101, an elongated cord 201, a golf ball 202, a base member 301, and a frame (401, 402, 404). A shown in FIGS. 3, 4, and 6A-7B elongated cord 201 includes a proximal end secured to rotating drum 101 and a distal end secured to golf ball 202 whereby golf ball 202 is tethered to rotating drum 101. As depicted generally in FIGS. 8, 23A and 25A in a first orientation base member 301 includes an impact layer 300 typically in the form of a mat or artificial turf over which a user swings a golf club. Within the impact layer 300 is positioned an impact area 302, 302*a*, which is a region of the impact layer 300 that is typically struck during the golf swing. As shown clearly in FIGS. 2 and 20, the frame includes frame base 401, an upward extending frame mast 404 and an outward extending frame arm 402. Frame base 401 can be reversibly attached to base member 301 using clips and frame mast 404 can be upwardly adjusted for differences in height and can be collapsed for storage. Quick release fasteners facilitate easy and fast collapse and adjustment of the frame mast 404 and frame arm 402 for storage. Frame arm 402 provides a mount for rotatably mounting rotating drum 101 whereby the frame holds rotating drum 101 in an elevated position above base member 301. Rotating drum 101 rotates freely in a rotational direction that is circular around frame arm 402. Accordingly, rotating drum 101 and golf ball 202 rotate around frame arm 402 when golf ball 202 is struck by a user to impart flight thereto. In some embodiments, while rotating drum 101 and golf ball 202 rotate around frame structure arm 402, at least one laser 102 (shown in more detail with the addition of FIG. 3) generates a laser beam which propagates substantially parallel along the path of golf ball 202 and at least one laser 103 but preferably two generates a laser beam which propagates parallel to a theoretical path of a fairway. As such, the straightness of a golf shot can be visually observed on a forward wall.

Figures 6A, 6B:
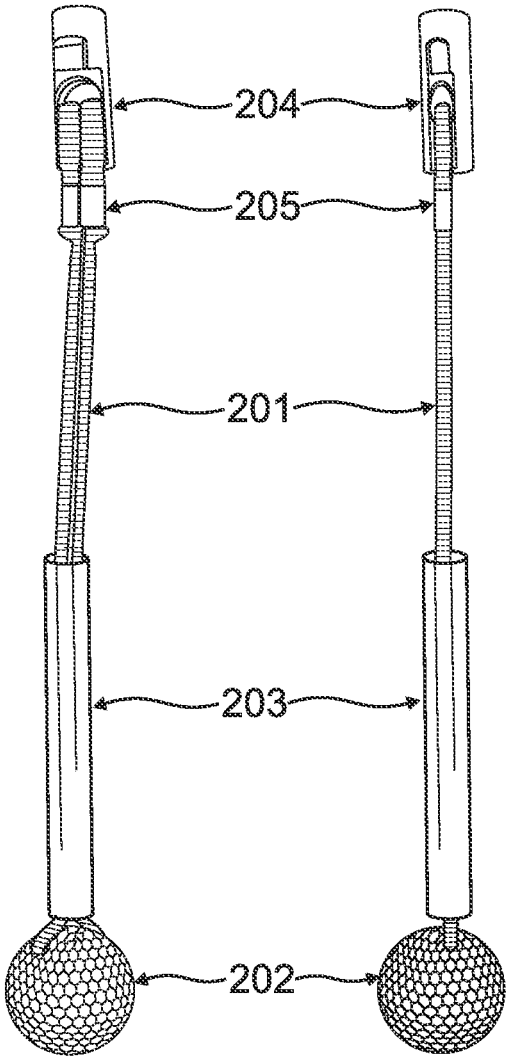
FIG. 6A is an enlarged front elevational view of one embodiment of elongated cord 201 and golf ball 202 and FIG. 6B is a side elevational view thereof.

As shown in FIGS. 6A and 6B, in some embodiments, elongated cord 201 is doubled on itself to define a distal cord loop and the distal cord loop passes through two holes in golf ball 202 to secure golf ball 202 to elongated cord 201. Preferably, the two holes are located on golf ball 202 at an angle relative to each other between 45° and 90°. In some embodiments elongated cord 201 is a 4 mm nylon rope doubled on itself and golf ball 202 is a standard two-piece golf ball. Preferably, a distal portion of elongated cord 201 is surrounded by a resilient structure 203. Preferably, resilient structure 203 is 130-150 mm in length and is constructed of a polymer, which can be opaque but is preferably transparent. Exemplary polymers include polypropylene, a variety of rubbers, and other suitable materials. In some embodiments two golf balls with elongated cords of different lengths are provided; a shorter one, such as 450-460 mm long to mimic a higher tee position for use with woods and a longer one, such as 475-485 mm long for use with irons to mimic a shorter tee or fairway approach.

The elongated cord 201 can be connected to the drum 101 using a variety of approaches. In some embodiments, the proximal end of elongated cord 201 is threaded in a FIG. 8 pattern through a female insert 204. The proximal end strands of the cord 201 are then crimped together with a steel clip 205. Female insert 204 can then be threaded into a male insert 104 for attachment to the drum 101. Preferably, female insert 204 and male insert 104 are constructed of stainless steel; however rigid polymer plastic would also be acceptable.

Figure 7B:
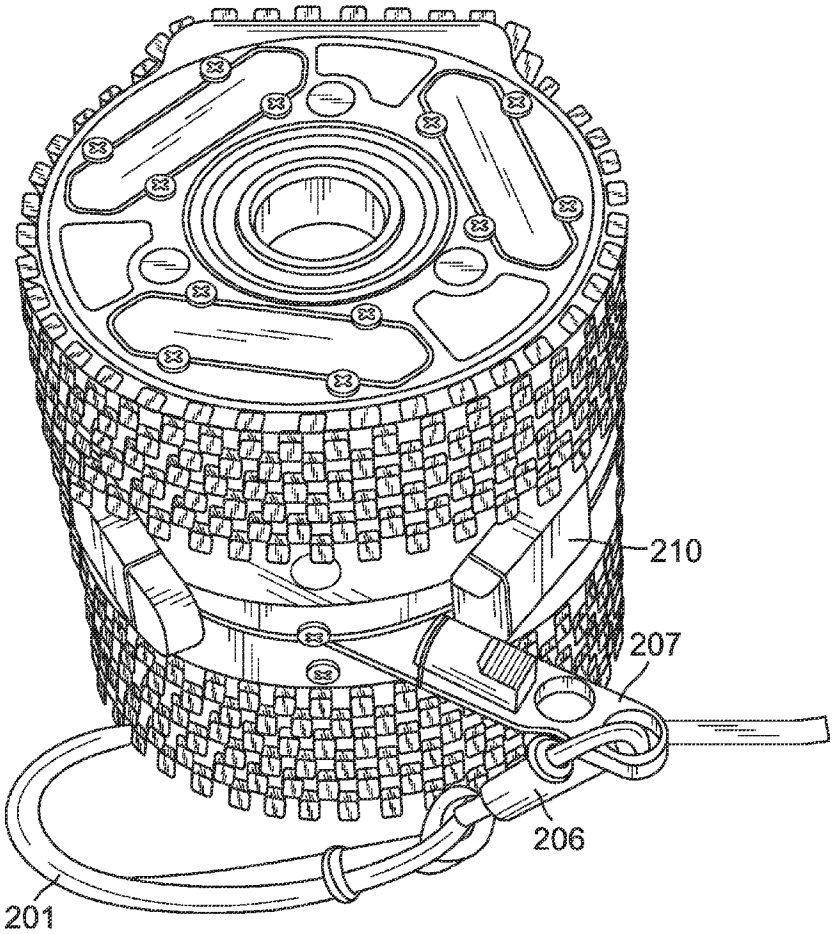
FIGS. 7A-B show an elongated cord 201 attached to a D-ring connector 206, which connects to an adapter 207.
Figure 7A:
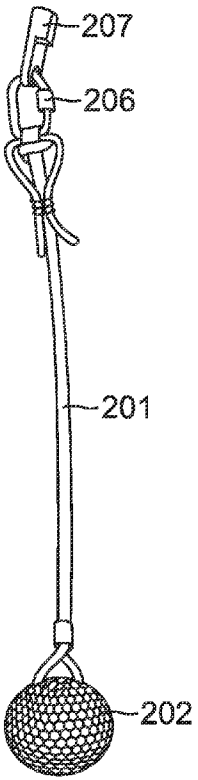

A related approach is shown in FIGS. 7A-B, which shows an elongated cord 201 coupled to a D-ring connector 206 that can selectively connect to an adapter 207, preferably having at least two apertures positioned one above the second to provide at least two ball heights, such as a first higher ball height for woods and a second lower ball height for irons. Alternatively, providing at least two apertures permits the user to compensate for stretching of the cord 201, which depending on its materials might occur during the life of the apparatus. The skilled artisan will appreciate that distances between the center of the two apertures can vary but in some instances it is between about 10 mm and 40 mm but more preferably about 15 mm to about 35 mm when selecting between a wood configuration or an iron configuration or in some instances less than 10 mm when compensating for a stretched cord 201. The skilled artisan will appreciate that by adding additional apertures and reducing their diameters the distances between neighboring apertures could be decreased and thus precision of ball positioning can be increased.

Referring now to FIGS. 1-10, in some embodiments, the drum 101 includes plurality of lasers (102, 103), such as laser diodes for visually tracking ball 202 trajectory. In some embodiments the plurality of lasers 102, 103 include one laser 102 of a first color and two lasers 103 of a second color. For example, as rotating drum 101 rotates around frame arm 402, laser 102 can project a green laser beam which follows the plane of rotating golf ball 202 and lasers 103 can project two red lines which simulate the path of a fairway. The resulting visual cue, which appears as three continuous laser beams on the floor, ceiling and adjacent walls, provides instant visual feedback to the user as to how square or straight golf ball 202 was hit at impact. For instance, if the green laser line stays within the two red laser lines, then the user knows the ball was hit straight. In some embodiments, lasers 102, 103 illuminate only when drum 101 is rotating, which saves battery life and prevents the laser beams from distracting the user at address. This can be accomplished using an electrical switch that activates during motion of the drum 101 or once a predefined speed of rotation is reached.

Figure 3:
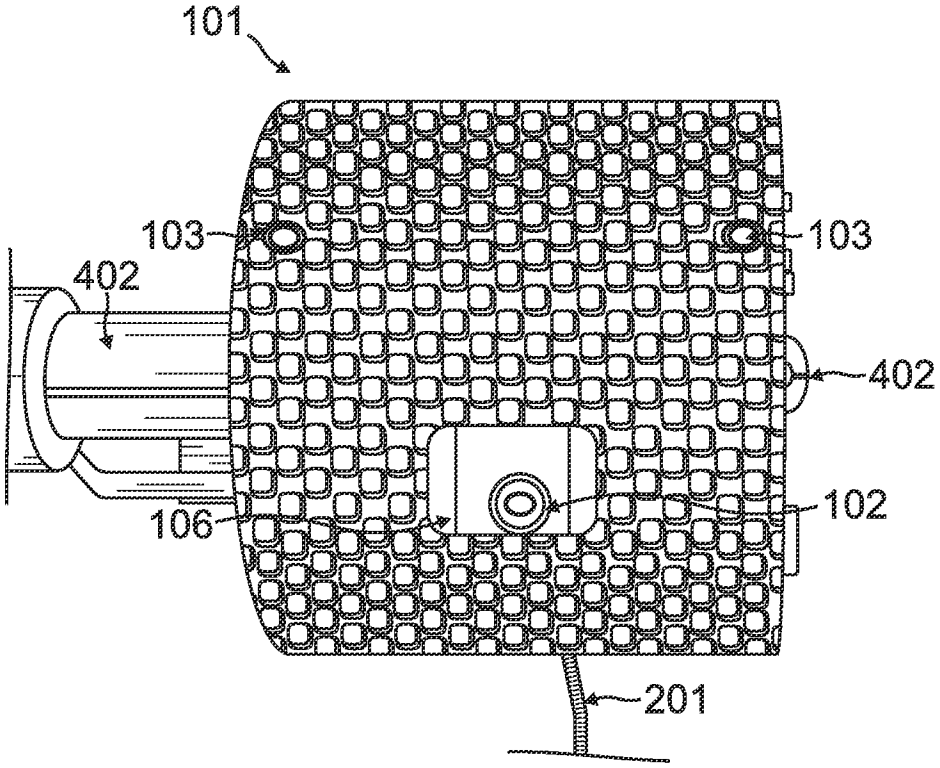
FIG. 3 is an enlarged top perspective view of one embodiment of rotating drum 101 showing lasers 102, 103.
Figure 4:
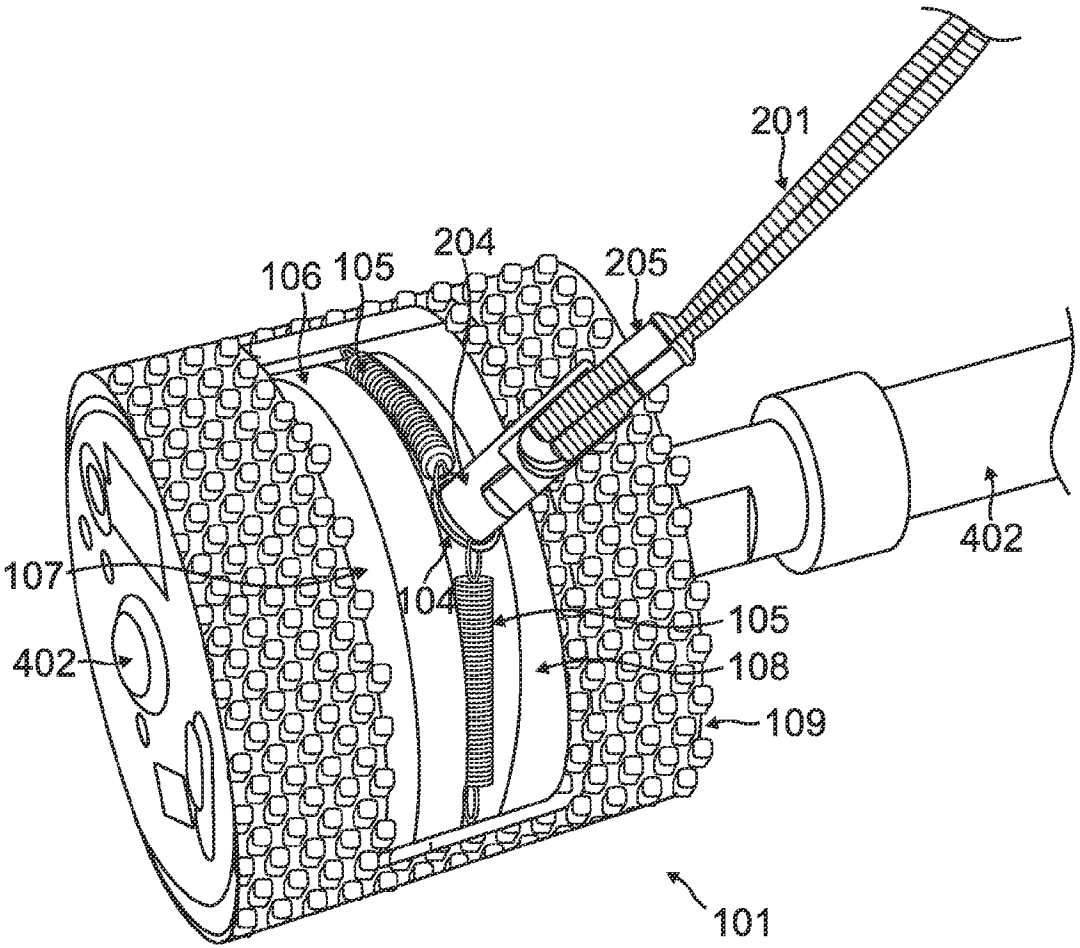
FIG. 4 is a bottom perspective view thereof.
Figure 5:
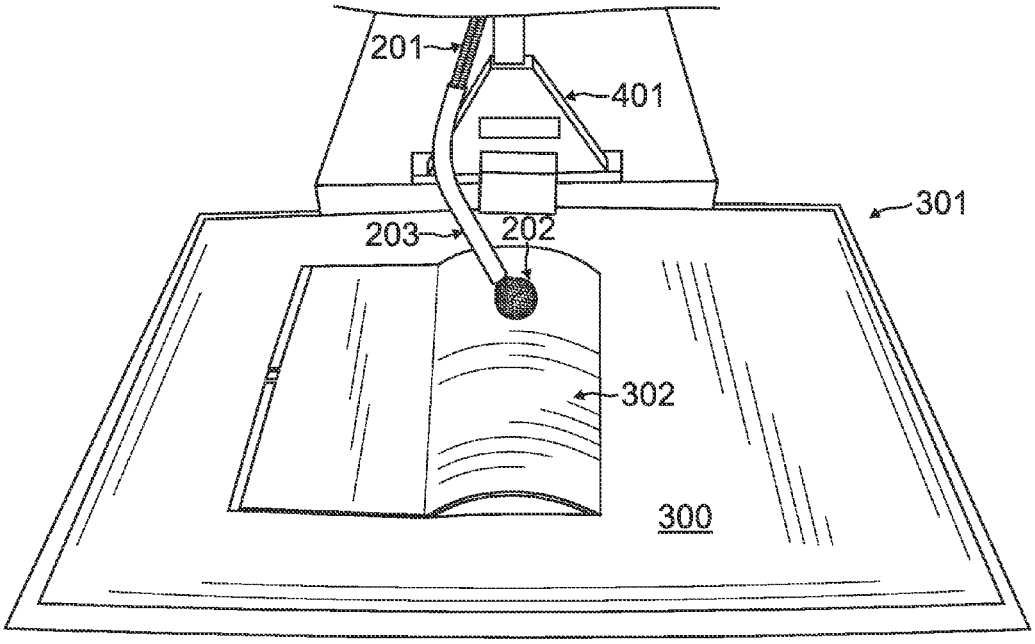
FIG. 5 is an enlarged front perspective view of a base member 301 showing a raised impact area 302 cut from a width of a surrounding impact layer 300 to stop a rotating golf ball 202.

Turning more directly to FIG. 4, in some embodiments, rotating drum 101 can include a drum core 108 which rotationally engages frame arm 402, a center swivel 106 which encircles drum core 108, and a drum cover 109 which is affixed to drum core 108 and covers drum core 108 and center swivel 106. Referring collectively to FIGS. 3 and 4, center swivel 106 can rotate from side to side over drum core 108 along the axis of rotating drum 101. Lasers 103 are mounted on drum core 108 perpendicular to the axis of rotating drum 101 such that lasers 103 project two red lines perpendicular to the axis of rotating drum 101 to outline a fairway. Laser 102 is preferably mounted on center swivel 106 and the proximal end of elongated cord 201 is secured to center swivel 106 such that the forces applied by rotating golf ball 202 cause center swivel 106 to move from side to side over drum core 101 and the green line projected by laser 102 follows the plane of rotation of golf ball 202. Drum cover 109 includes apertures exposing lasers 102 and 103 and male insert 104. Male insert 104 is secured to center swivel ring 106 by means of a pin 107 and is located in a crevice along a portion of the circumference of center swivel ring 106. Elongated cord 201 is secured to rotating drum 101 by means of female insert 204 which threads into male insert 104. Male insert 104 can swing freely in the crevice in directions perpendicular to the axis of rotating drum 101 to absorb ball impact forces. Springs 105 may be secured to either side of male insert 104 and to the ends of the crevice to further absorb impact forces as shown in FIG. 4; however as picture in FIG. 7B, impact bumpers 210 may be provided as an alternative to springs or in addition to springs.

Figure 2:
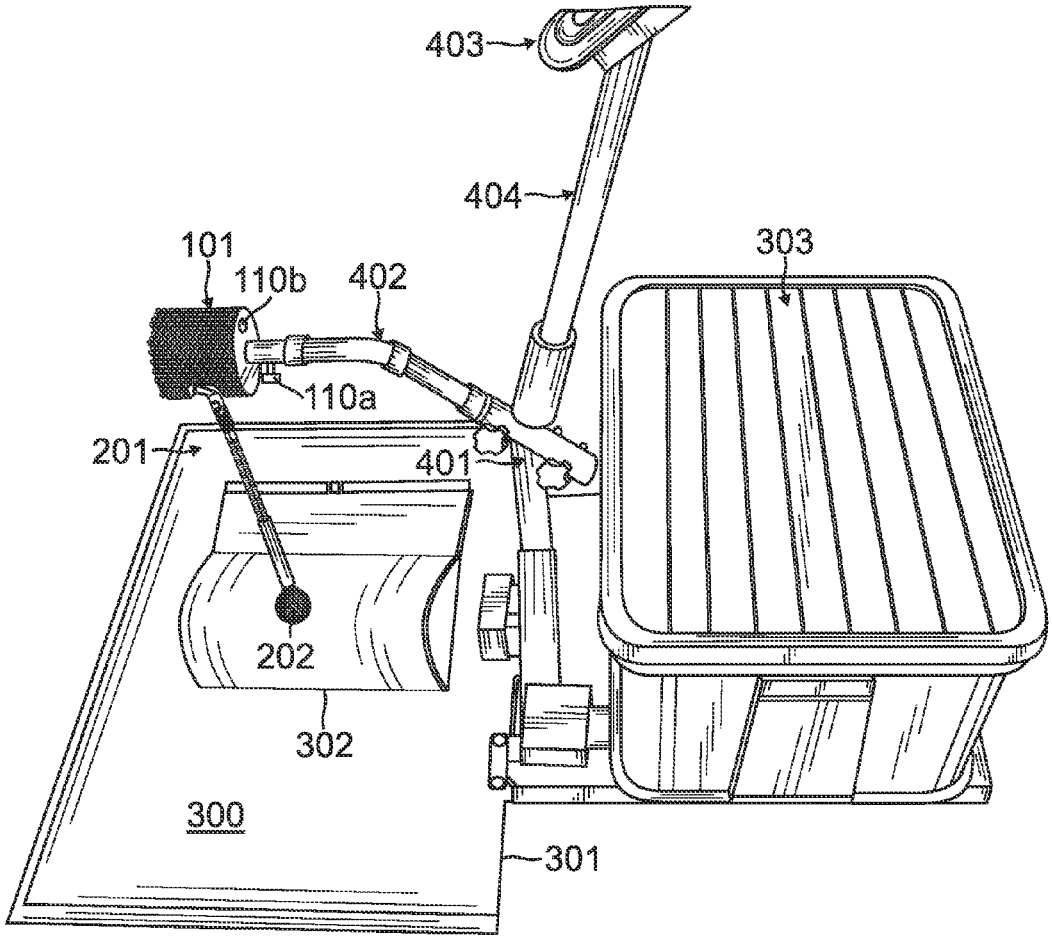
FIG. 2 is a side perspective view thereof.

Turning to FIG. 2, in some embodiments, the frame is constructed of steel and in others plastic. Preferably, frame arm 402 is height-adjustable and is constructed of solid steel which can safely withstand impact and centrifugal forces induced by a 145 miles per hour swing. Yet, preferably, frame arm 402 can be adjusted such as rotated around or pivot along frame mast 404 to collapse the apparatus for storage. Securely holding the frame arm 402 in place can be performed using latches or other securing structures known in the art.

In some embodiments, the frame includes an upper frame 404 adjustably positioned at one end to frame base 401 and at a distal end to a means for displaying swing data 403, such as a display screen, tablet computer, mobile phone or other device with monitor. Display means 403 or consol 902 (shown in FIG. 17A) may display any or all of the following: club selection, ball flight distance, club head speed, ball angle, driving accuracy percentage, total swings, best shots, and averages.

Figure 26:
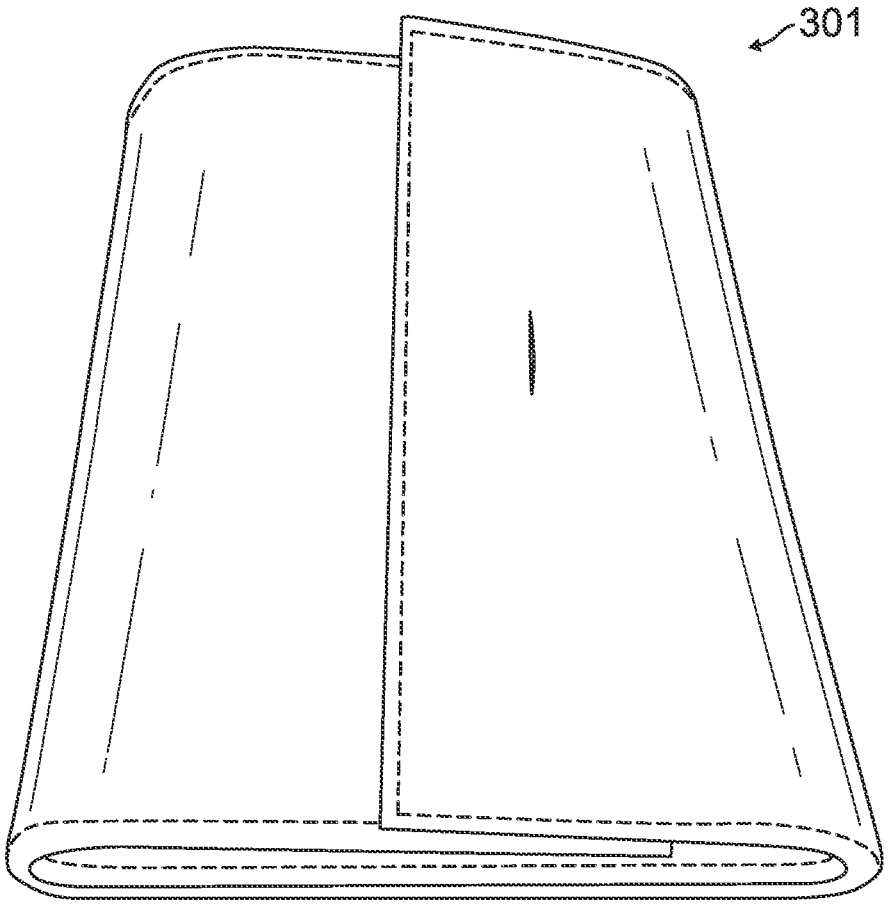
FIG. 26 shows a folded base member 301 for storage.

In the some embodiments, the base member 301 is a two-layered mat. The top layer being characterized as an impact layer 300, below which is a bottom layer 305 that serves as a base and which can be a 3-7 mm rubber mat to add rigidity and cushion a swing impact. Both layers 300, 305 may be soft and foldable. In some embodiments, the rigidity of the combined impact layer 300 and bottom layer 305 is greater at some regions than others, which may be preferred to form fold lines for folding the base member 301 for storage as shown in FIG. 26. Alternatively, the bottom 305 may be a constructed of rigid plastic.

Figure 24:
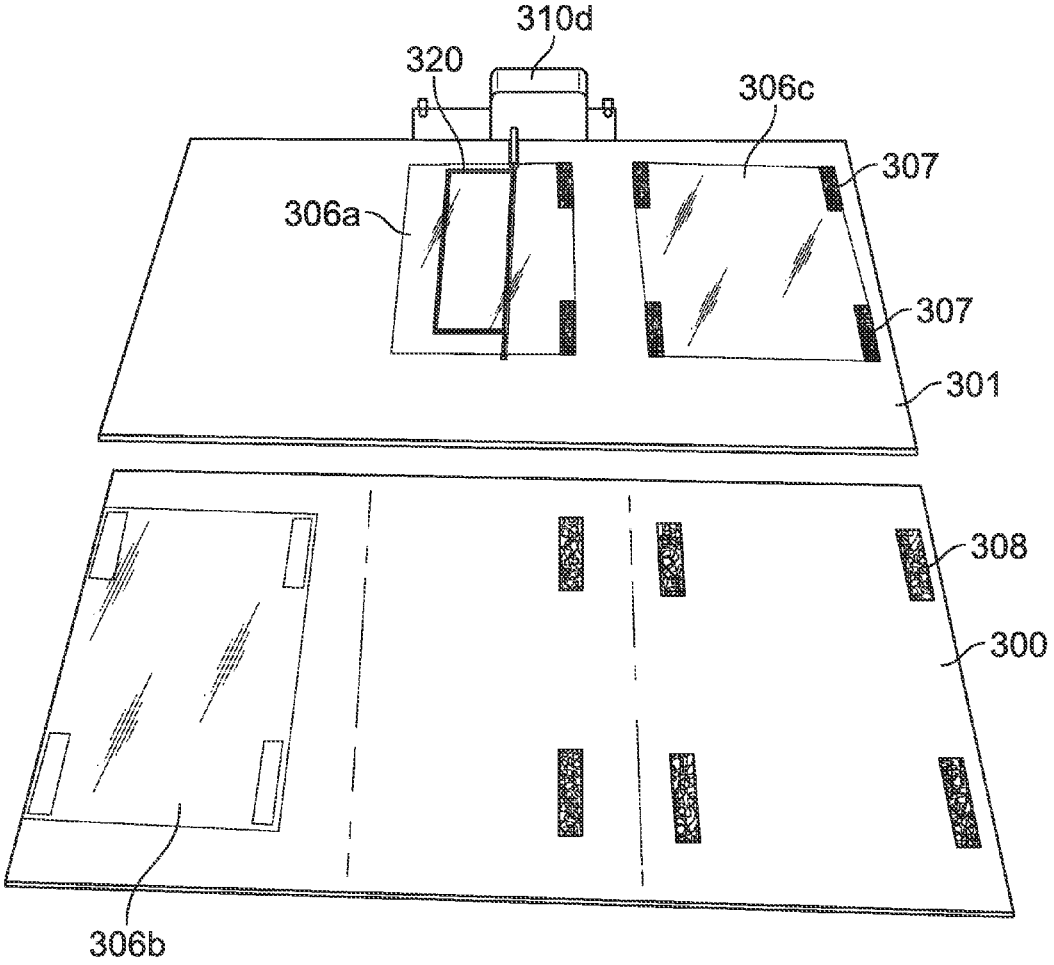
FIG. 24 is a perspective view of the bottom layer 305 (upper figure), and an upside down impact layer 300 (lower figure) showing complementary attachment structures (307, 308) for selectively securing one end of the impact layer 300 to the bottom layer 305 thereby selectively sliding an unsecured opposing end when rotating the paddle 320 to a raised orientation.

As shown in FIGS. 5, 8, 19-22B at least a portion of the impact layer 300 raises to a second orientation. As demonstrated in FIGS. 5 and 21, this stops rotation of the golf ball 202. Transitioning the impact layer 300 (or more specifically at impact area 302, 302*a*) from a first planar orientation to a second raised orientation can be performed using a variety of approaches. Further, raising the impact layer 300 can begin using a variety of triggers. For instance, the impact layer 300 can be raised into the second orientation after the golf ball 202 makes several revolutions. This can be accomplished by including programming which counts revolutions of the drum 101 and thus upon equaling a predetermined value the impact area 302, 302*a* is raised. Counting revolutions can be performed by counting the passing of a magnet 110*b* with a magnet sensor 110*a* as shown in FIGS. 2 and 24. Alternatively, once rotation begins a timer may provide a timed delay for initiating raising the impact area 302 or 302*a*. In any event, a raised impact area 302 or 302*a* is provided to slow or stop the golf ball 202 and sets it for the next swing. Accordingly, the user need not move from his stance between swings. Generally the impact area 302, 302*a* is lowered after a predetermined time period, which in some embodiments can be increased or decreased through programmed menu options offered to the user. In other embodiments the impact area 302, 302*a* is lowered once rotation of the drum 101 meets a predetermined rotational threshold. For instance, once the drum 101 stops rotating or sufficiently reduces rotational speed, the impact area 302, 302*a* may be lowered. This can be accomplished by timing rotations or by detecting when rotation has stopped or substantially slowed. The skilled artisan will appreciate that the above features can be programmed into the processor 905 (see FIG. 17B) Consistent with prior descriptions, monitoring rotation can be accomplished using a magnet sensor 110*a* that detects the rotational passing of a magnet 110*b* as shown in FIG. 2.

Figure 10:
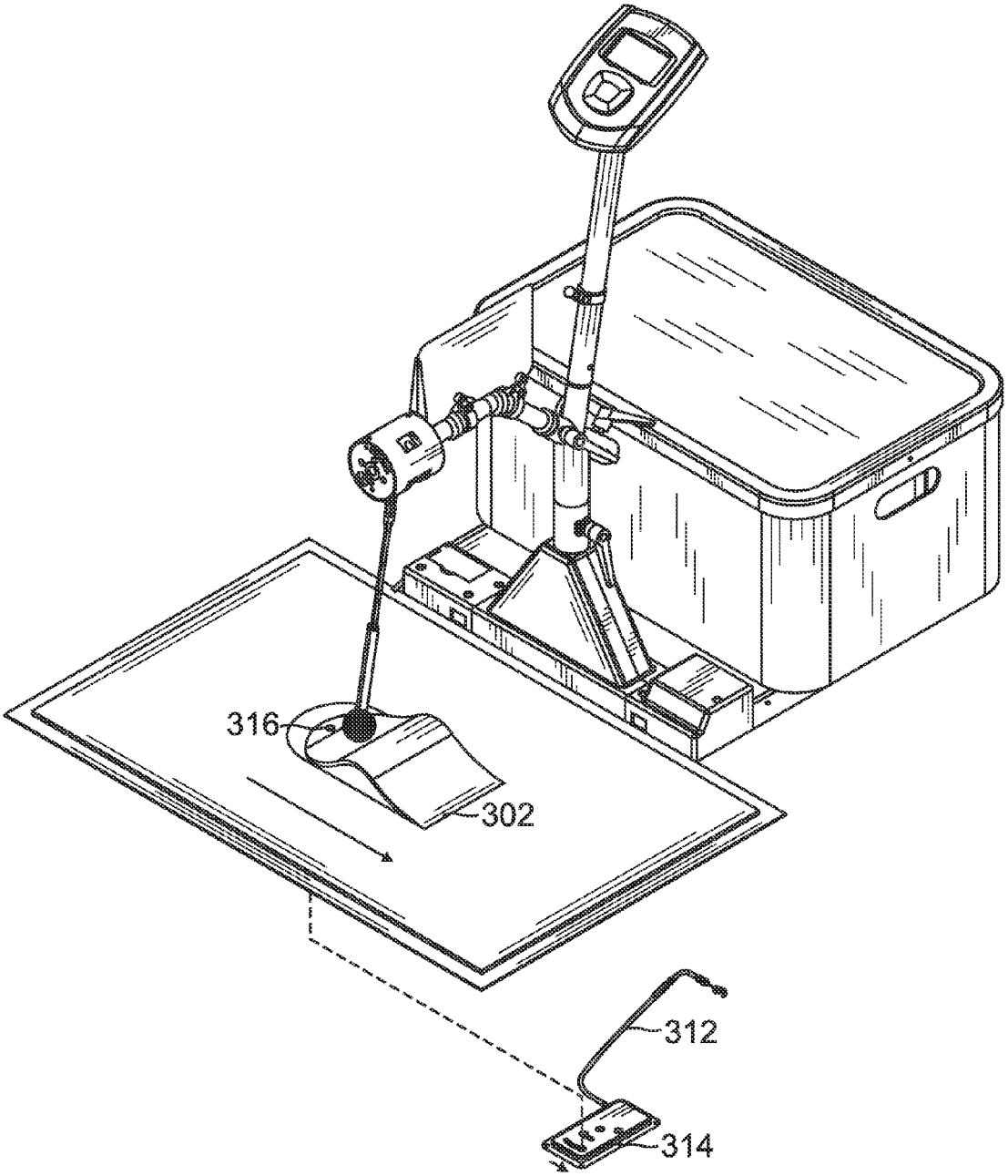
FIG. 10 is a schematic demonstrating raising an impact area 302.
Figure 11:
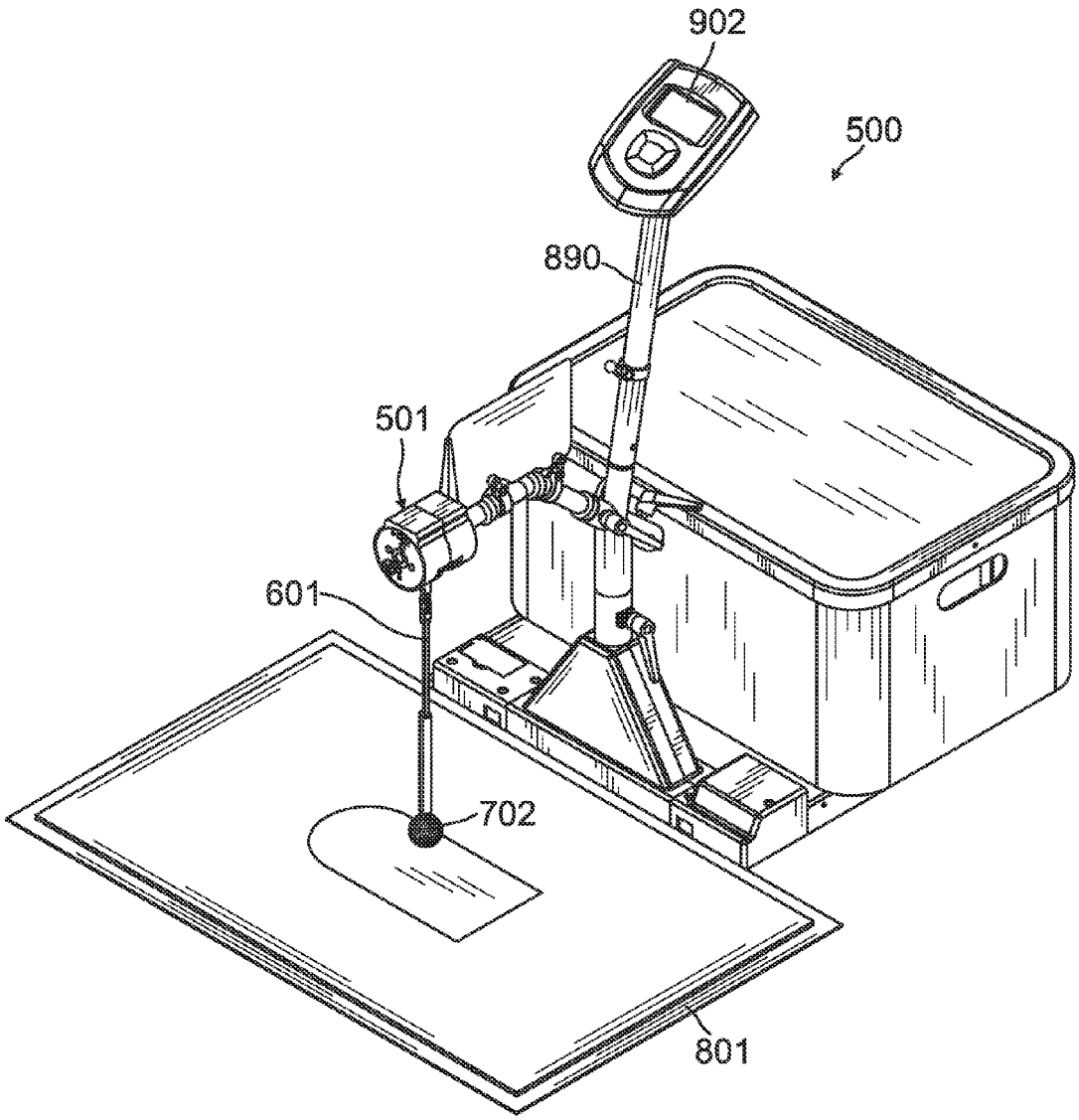
FIG. 11 is a perspective view of a related embodiment of a golf swing apparatus 500 including optical drum 501.
Figure 19:
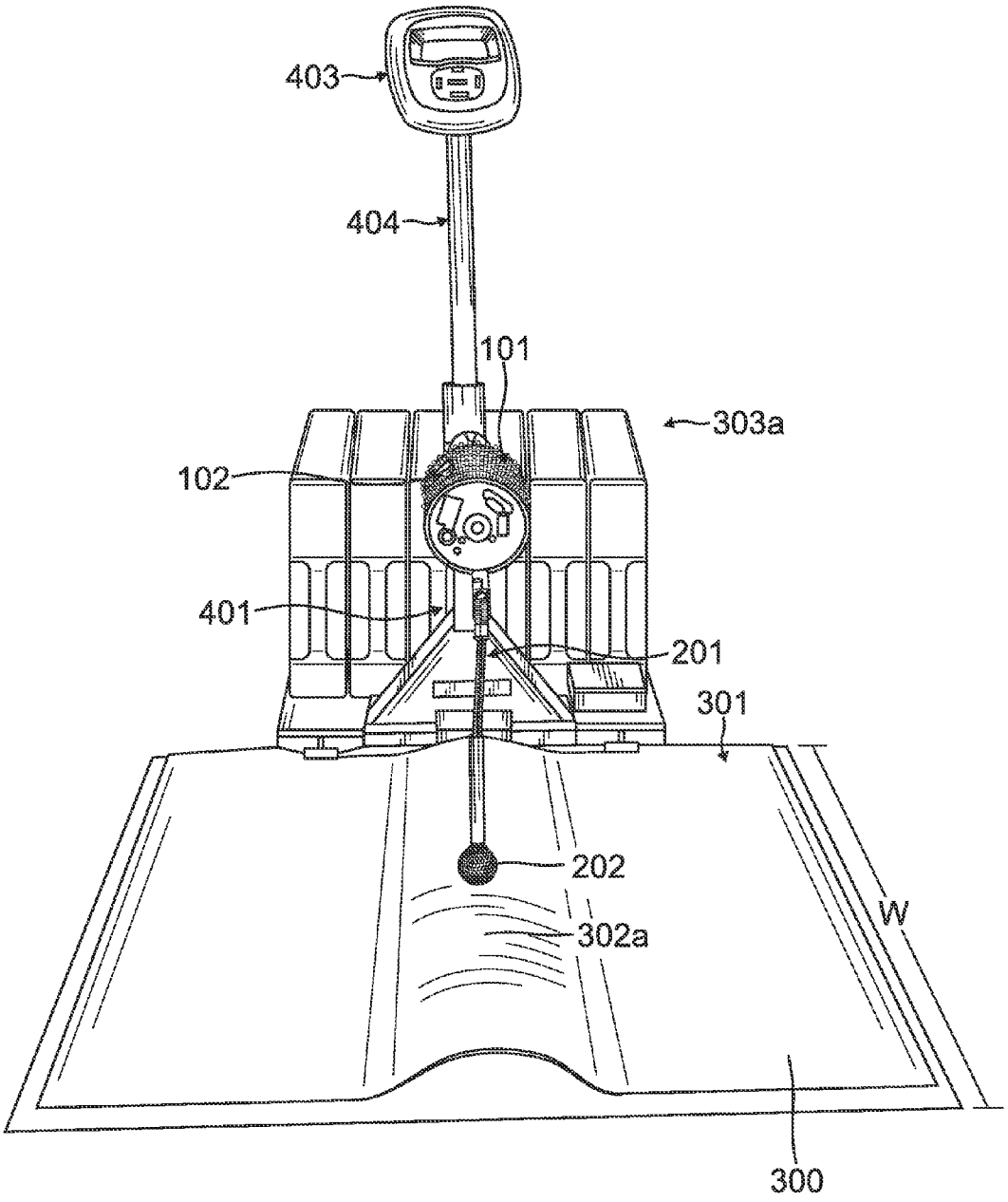
FIG. 19 is a front perspective view of another related embodiment of a golf swing apparatus showing the entire width W of the impact layer 300 including the impact surface 302*a* in a raised position.
Figure 21:
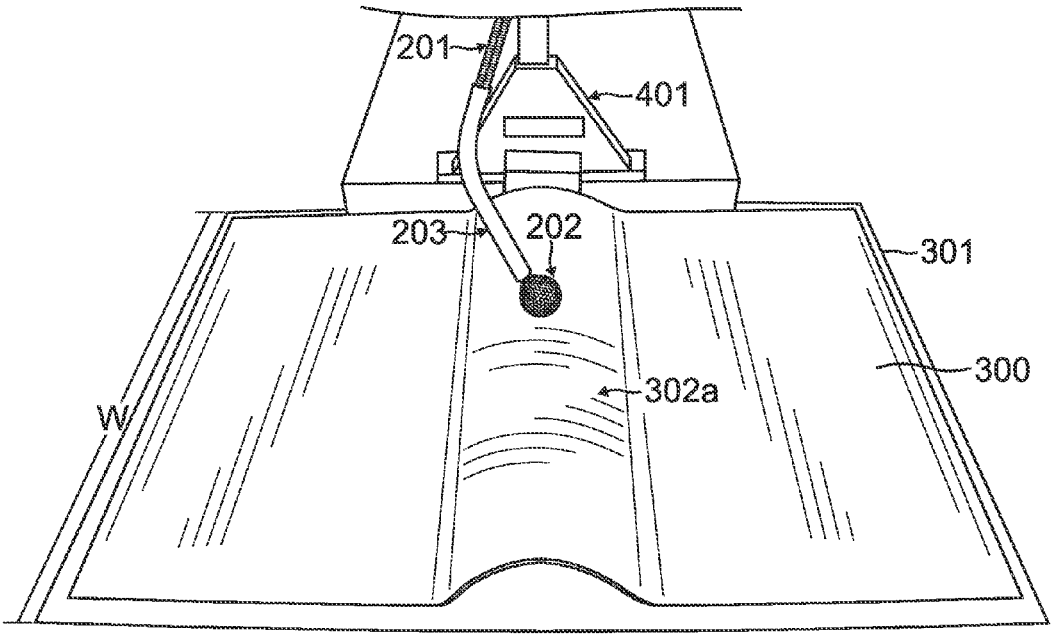
FIG. 21 is an enlarged front perspective view showing the entire width W of the impact layer 300 including a bulging impact surface 302*a* in a raised orientation to stop a rotating golf ball 202.

In one approach as shown in FIGS. 1 and 10 the impact area 302 is a three-sided flap cut out from a center portion of the impact layer 300 of base member 301. However, as shown in FIGS. 19 and 21, the impact area 302*a* can extend the entire width W of the impact layer 300 of the base member 301 and thus not require additional cutting of the impact layer 300. The flap configuration may be preferred if the user wishes to stand on the impact layer 300 when striking the ball 202.

Figure 22A:
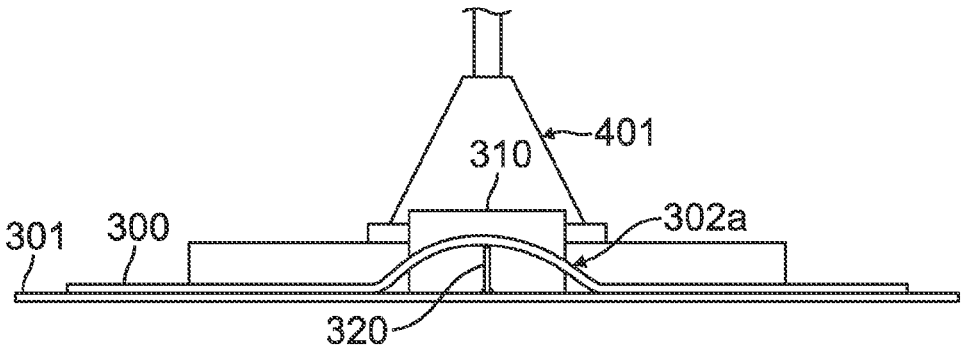
FIG. 22A shows a partial front elevational view of the impact layer 300 in a raised orientation by means of a rotatable paddle 320 attached to a motor 310*d*.
Figure 22B:
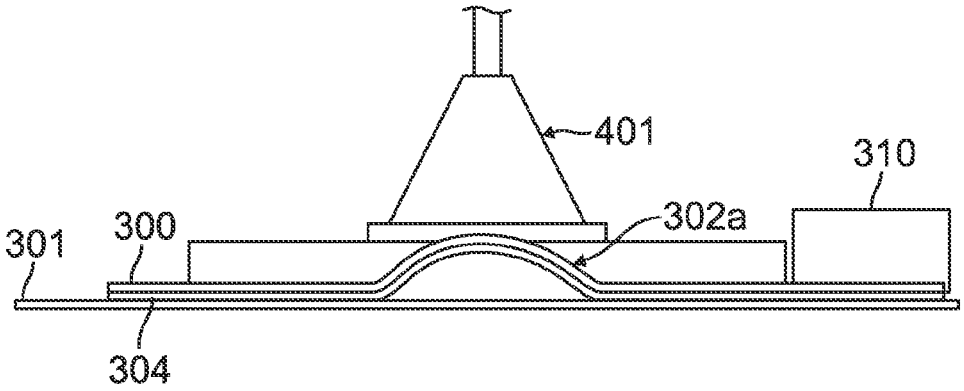
FIG. 22B shows a related embodiment where the impact layer 300 is raised orientation by means of a pull motor 310*e*.
Figure 23A:
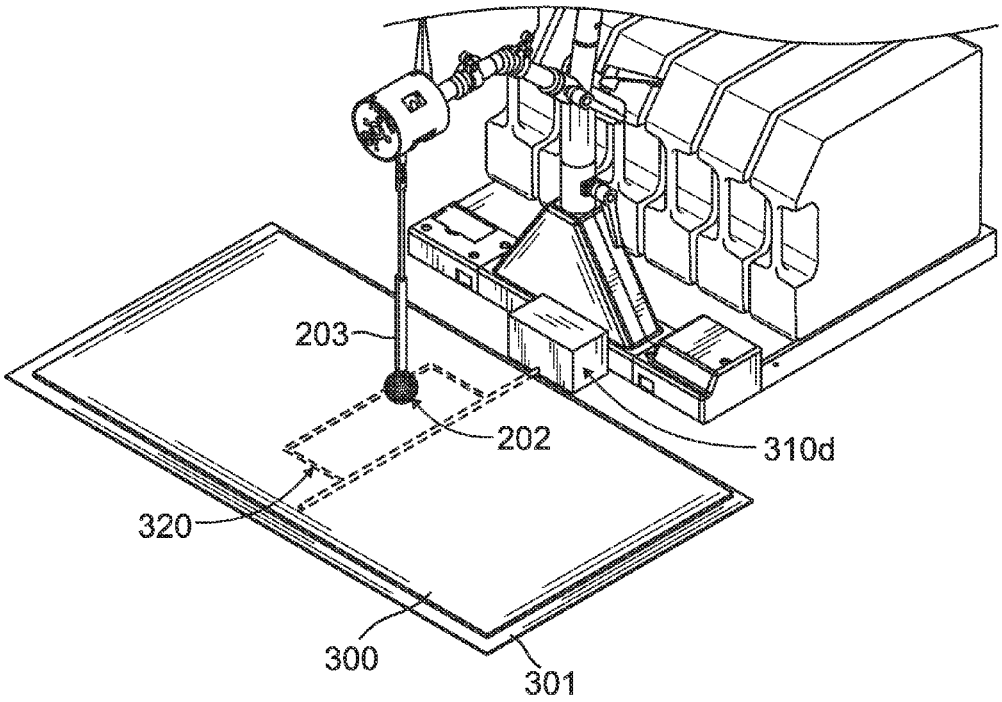
FIG. 23A is perspective view demonstrating a first orientation or downward position of an impact layer 300 characterized by the planar and parallel alignment of a paddle 320 positioned underneath the impact layer 300*a*.
Figure 23B:
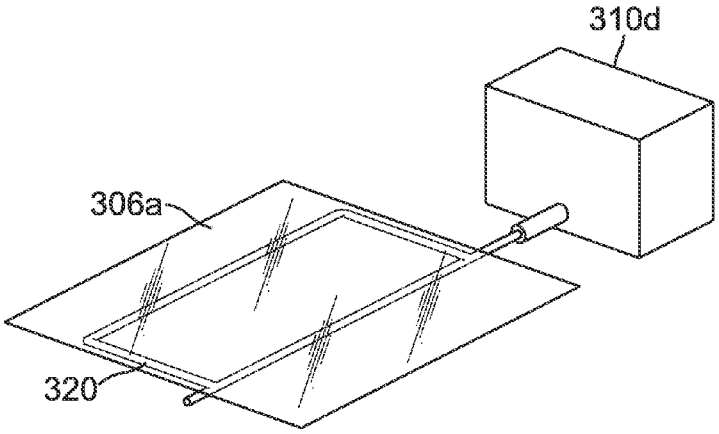
FIG. 23B is a schematic showing a variation where a transparent friction reducing sheet 306*a* overlays the paddle 320 for more efficient rotation, which remains connected to a motor 310*d*.

In some embodiments, the means for raising the impact area 302 includes an elastic band which is attached to the underside of the flap and stretches across base member 301 where it is anchored. In this configuration, the tension of the elastic band causes the impact area 302 to bow or bulge upwards in the center. As shown in FIGS. 22A, 23A, another approach includes a paddle 320 beneath the impact layer 300 which is rotated clockwise or counterclockwise by a motor 310*d* to extend the impact area 302*a* upward. As shown in FIG. 24, such upward extension is accomplished by selectively securing only one end of the impact layer 300 to the bottom layer 305 using complementary attachment structures 307, 308, such as hook and loop (VELCRO). In still another approach cables 340 pull an unsecured end of the impact layer 300 to a secured end thereby sliding and raising a select portion of the impact layer 300. The opposing endmost regions defining the length of the impact layer 300 preferably remain planar.

Figure 8:
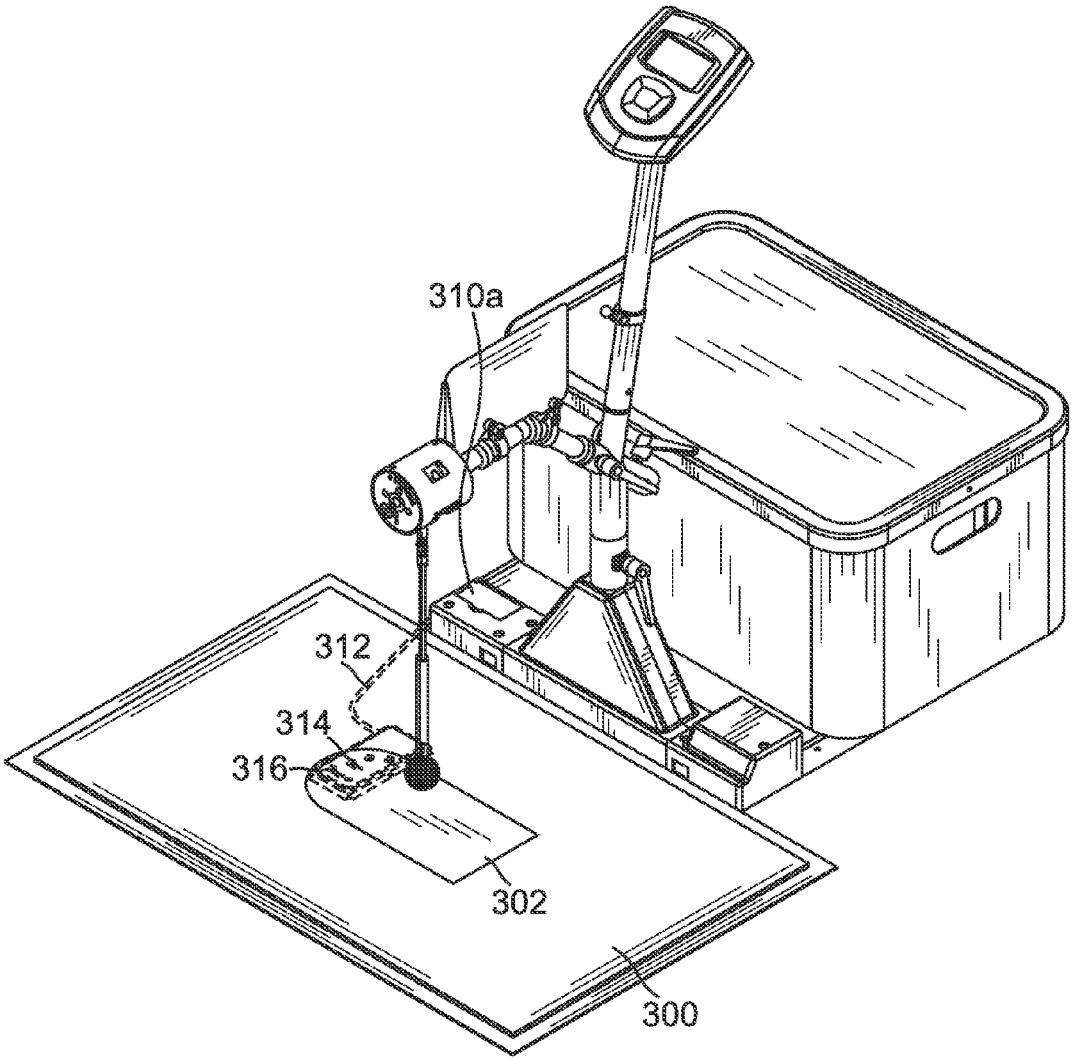
FIG. 8 is perspective view demonstrating the positioning of a slide mechanism 314 positioned underneath an impact layer 300 for raising and lowering an impact area 302.
Figure 9B:
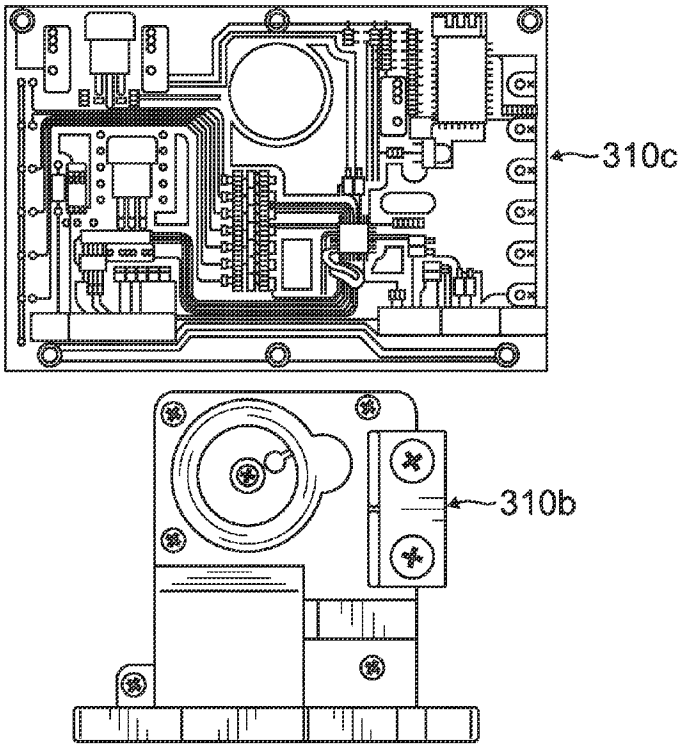
FIG. 9B depicts a motor 310*b* coupled to motor circuitry 310*c*.
Figure 9A:
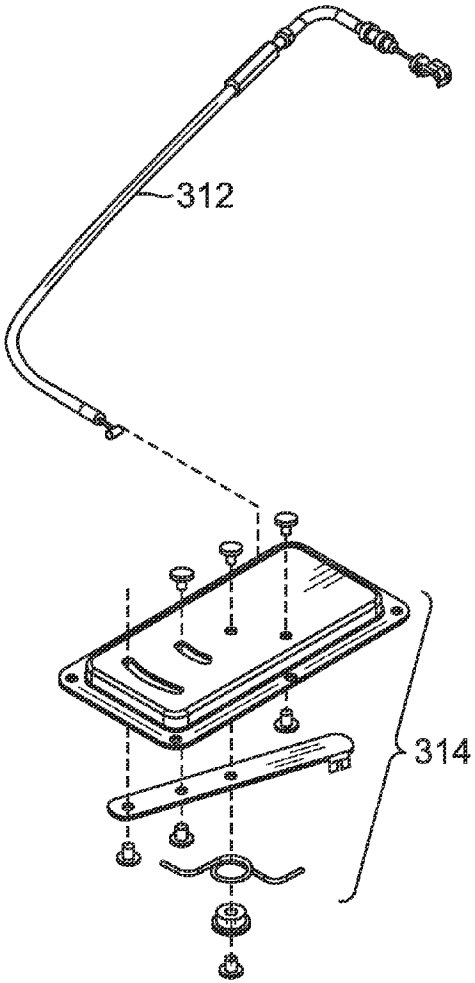
FIG. 9A is a schematic showing a slide mechanism 314 and cable 312.

FIGS. 8-10 depict another approach to regulate the raising and lowering of impact area 302. Specifically, a means for raising the impact area can include a motor 310*b* stored in a motor housing 310*a* that is attached to a cable 312, which itself runs from the motor 310*b* underneath or within base member 301 to a slide mechanism 314 that is mounted to the base member 301, and underneath the impact area 302. The slide mechanism 314 includes attachment site 316, which attaches to the flap at the impact area 302. As shown in FIG. 8 and in view of FIGS. 9A and 9B, when the motor circuitry 310*c* is not activated (off position) the motor cable 312 is unwound or spooled out, which releases the slide mechanism 314 to the left, thus flattening the bulge and lowering the flap to a flat position, flush with the rest of the top layer of base member 301 thereby forming a flat impact area 302. When the motor circuitry 310*c* is activated, the cable 312 is wound tight by the motor 310*b* thereby increasing tension of the slide mechanism 314 and thus the flap is pulled to the right at the attachment site 316 which causes the flap to bow upwards and raise the impact area 302. The skilled artisan will appreciate variations exist for the means for raising the impact area 302. For example, suitable mechanisms can be formed using various levers, springs and the like, which provide substantially the same effect and thus would also be encompassed by the invention.

FIGS. 19-25B detail two other previously introduced variations to regulate the raising and lowering of the impact area 302*a* that involve raising the entire width of the impact layer 300 though each could be adapted for the flap configuration also. Specifically, in FIGS. 19-24, a means for raising the impact area 302*a* raises the entire width of the top layer 300 using a motor 310*d* attached to a rotating paddle 320, with paddle 320 lying underneath the impact area 300 and optionally recessed within a channel in the bottom layer 305 of the base member 301 (shown more clearly in FIGS. 23A and 23B). The paddle 320 can span the entire width of the top layer 300 but preferably spans at least 50 percent of the width, most preferably about the center of the width of the impact layer 300. The paddle 320 may be made of plastic, metal or any other rigid material suitable for raising the impact region 302*a* of the impact layer 300 from the bottom layer 305. The top surface of the paddle 320, exposed to the lower surface of the impact layer 300, can be covered by a flexible friction reducing membrane 306*a* which reduces the friction between the paddle 320 and impact layer 300 while raising of the impact area 302*a* thereby requiring less energy for rotation The membrane 306*a* may be plastic, polycarbonate or other friction reducing material know to those skilled in the art. Alternatively or in addition, the membrane 306*a* may be coated with a friction reducing coating, such as but not limited to silicon or polytetrafluoroethylene (PTFE). Alternatively or in addition, the paddle 320 may be equipped with rolling wheels to reduce friction against the impact layer 300 during raising. Further, the membrane 306*a* may add rigidity to the impact layer 300 to decentralize lifting forces away from the point of contact with the paddle 320 to lift a larger region, whether width or length, compared to without the membrane 306*a*. Preferably the impact layer 300 is detachably secured to the bottom layer 305 by means of hook 307 and loop 308 (VELCRO), snaps or other detachable means know to those skilled in the art to allow replacement of impact layer 300 when worn. The impact layer 300 is secured to the bottom layer 305 only one half of the base member 301 relative to the frame structure arm 402. For instance, sheet 306*c* provides a region for attachment as well as part of friction reducing membrane 306*a*. The other half of the impact layer 300 is not secured to the bottom layer 305 to permit sliding the unsecured end of the impact layer 300 over the bottom layer 305 to raise the impact area 302*a*. The unsecured half of the impact layer 300 can also lie over another piece of friction reducing membrane 306*b* attached to the bottom layer 305 of the base member 301 for reducing friction during sliding to more efficiently and smoothly raise and lower the impact area 302*a*, and the dimensions of the friction reducing material 306*b* are preferably no larger than the dimensions of the above lying unsecured portion of the impact layer 300. The motor 310*d* rotates the paddle 320, which again is preferably covered on the upper side with friction reducing material 306*a*, to a near vertical position (as shown in FIG. 22A) thus raising the impact area 302 of the top layer 300 (FIG. 22A) to make contact with the rotating golf ball 202 (FIG. 21). After striking the ball 202, the motor 310*d* returns the paddle 320 to its first or down position thereby lowering the impact layer 300 to its substantially planar position in a state ready for the next golf swing. Alternatively, the motor 310*d* may release tension thereby permitting counter acting springs to return the paddle to the first position.

Figure 25A:
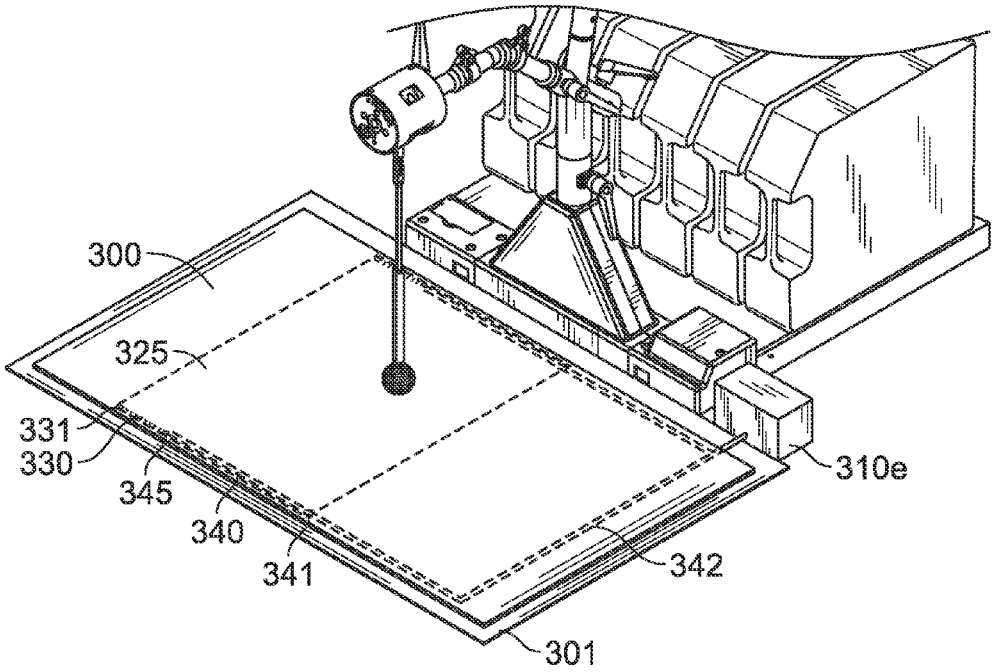
FIGS. 25A and 25B show a related embodiment of a base member 301 incorporating pull cables 340 to pull the impact layer 300 to its second or raised orientation and corresponding return springs 330 to return the impact layer 300 to its first or planar configuration upon release of the pulling motor 310*e*.
Figure 25B:
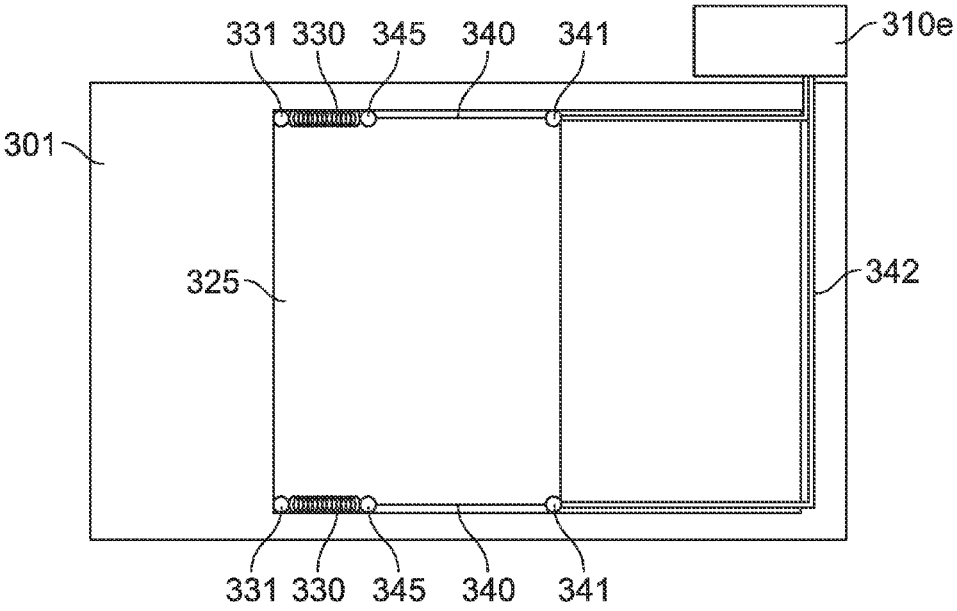

Another of the previously introduced variation for regulating the raising and lowering of the impact area 302*a* and in particular directed to raising the entire width of the impact layer 300 is detailed in FIGS. 25A and 25B. The approach involves the bowing or bulging of the impact layer 300 using a pull motor 310*e*. A rigid sheet 325, preferably about one third the length of the impact layer 300 and spanning at least seventy five percent (75%) of the width of the impact layer 300, is situated on the base layer 301 with its midline preferably beneath the frame structure arm 402. Located at all four corners of the rigid sheet 325 can be potential anchor points 331, 341 for routing or attachment of cables 340 or return springs 330. Anchor points 331 lying at the corners of one side of the rigid sheet 325 relative to the frame arm 402 can be fixed anchoring points for the ends of two springs 330. The opposing ends of the two springs 330 can be connect to attachment sites 345 about midway between the spring anchor points 331 and the midline of the rigid sheet 325. Also connected to the attachment site 345 are the ends of two cables 340 which run on both sides the length of the base member 301. In some embodiments, the cables 340 are without an outer sheath from the attachment site 345 on the underside of the middle layer 304 to anchor points 341 which lie in the corners of the rigid sheet 325 opposite the spring anchors 331 and on the other side of the frame arm 402. Optional sheath anchor points 341 which lie in the corners of the rigid sheet 325 opposite the spring anchors 331 and on the opposite side of the frame arm 402 anchor sheaths through which cables 340 travel to the pull motor 310*e*. The anchor points (331 and 341) and attachment site 345 are preferably linear on both sides of the base member 301. The cables 340 enter the sheaths at the anchor points 341, and the sheathed cables 342 continue to extend down both sides of the base member 301. In such an approach, the sheaths 342 on both sides of the base member can remain stationary while the cables 340 within move freely with the pull action of the pull motor 310*e* and return springs 330. The middle layer 304 or impact layer 300 is connected to the bottom layer 305 and the edge of the rigid sheet 325 only on the side of the base member akin to FIG. 24, which contains the pull motor 310*e*. On the opposing side of the base member 301 the middle layer 304 or impact layer 300 is not attached to the bottom layer 305 and moves freely over the bottom layer 305. The process of raising and lowering the impact area 302*a* and the entire width of the impact layer 300 depend on the activation of the pull motor 310*e* and the springs 330. To raise the impact layer 300 the pull motor 310*e* is activated pulling the cables 340 which in turn pulls the attachment points 345 connected to the middle layer 304 or impact layer 300 toward the secured end lying on the other side of the frame arm 402. The movement causes the impact layer 300 to bulge upward (see FIG. 22B). This causes the impact layer 300 to make contact with the rotating golf ball 202 (see FIG. 21). The pulling of the cables 340 by pull motor 310*e* increases the tension of the springs 330. After striking the ball, the motor 310*e* releases its tension and the return springs 330 pull the impact layer 300 back towards the spring anchor points 331 lowering the attached impact layer 300 to its first orientation position in a state ready for the next golf swing.

Figure 20:
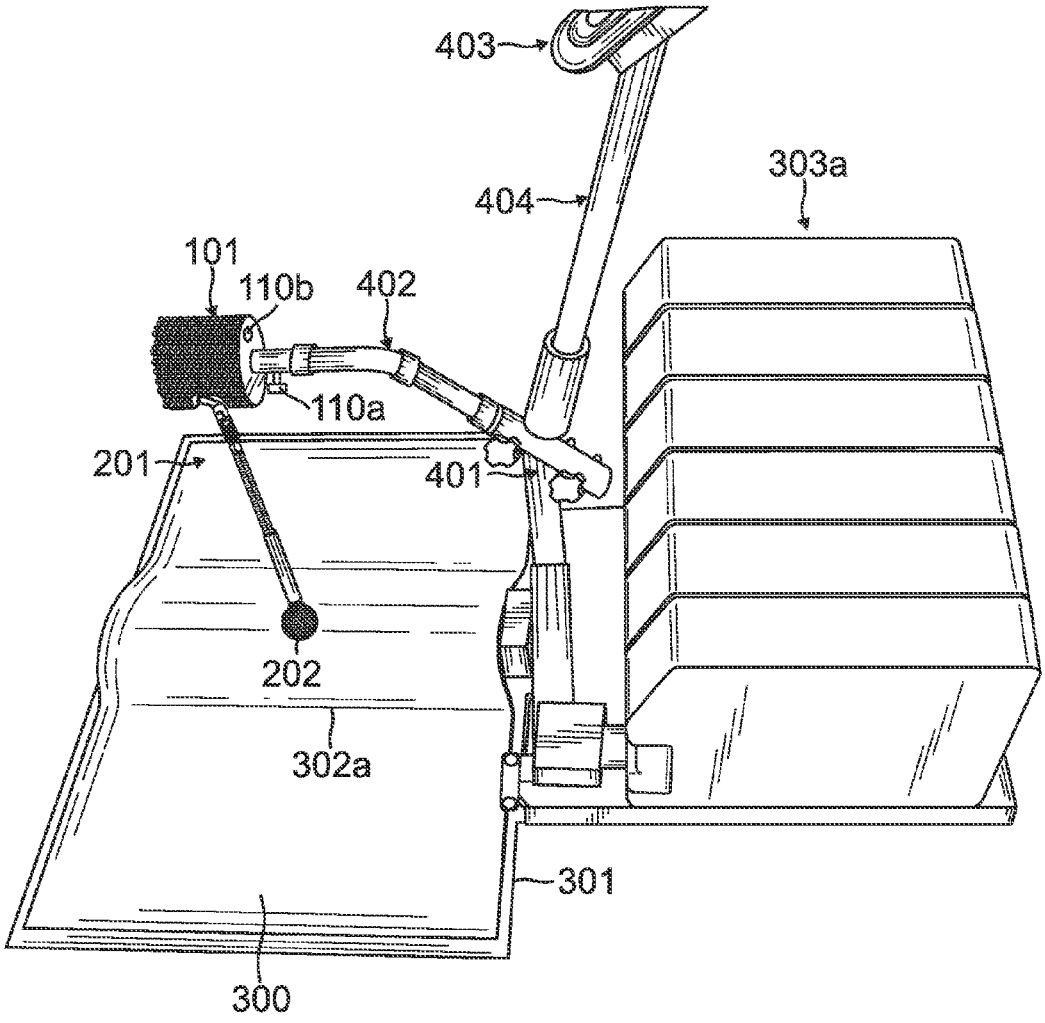
FIG. 20 is a side perspective view thereof.

Returning to FIGS. 1 and 2, in some embodiments, the apparatus also includes a ballast, preferably in the form of a water tank 303, secured to base member 301 to provide stability to the frame structure when water tank 303 is filled with water. In some embodiments the water tank 303 is a 17 gallon water container which securely anchors base member 301 to the ground or floor when filled to accommodate the centrifugal forces on the ball-tether system. Alternatively, as shown in FIGS. 19 and 20, the ballast may be in the form of group of smaller tanks 303*a* for easier handling. In one embodiment the group of tanks 303*a* may be 4×20 liter tanks. In another embodiment the group may be in the form of 6×13 liter tanks 303*a*. The combined weight of base member 301 and 17 gallons of water provides over 170 lbs of weight to offset the impact and centrifugal forces of a 145 mile per hour swing. The container is easy to fill and empty, facilitating the transport of the present invention from place to place, such as from the basement or garage out to the patio or lawn. Naturally, one could also place other media in the water tank 303 or tanks 303*a* such as sand, gravel and the like or provide other means for reducing movement of the apparatus; however, water tends to be the preferred media and approach. The larger water tank 303 can also double as a packaging box or space, where all of the device's disassembled parts and components can be placed or packaged, for storage or shipping.

Figure 14:
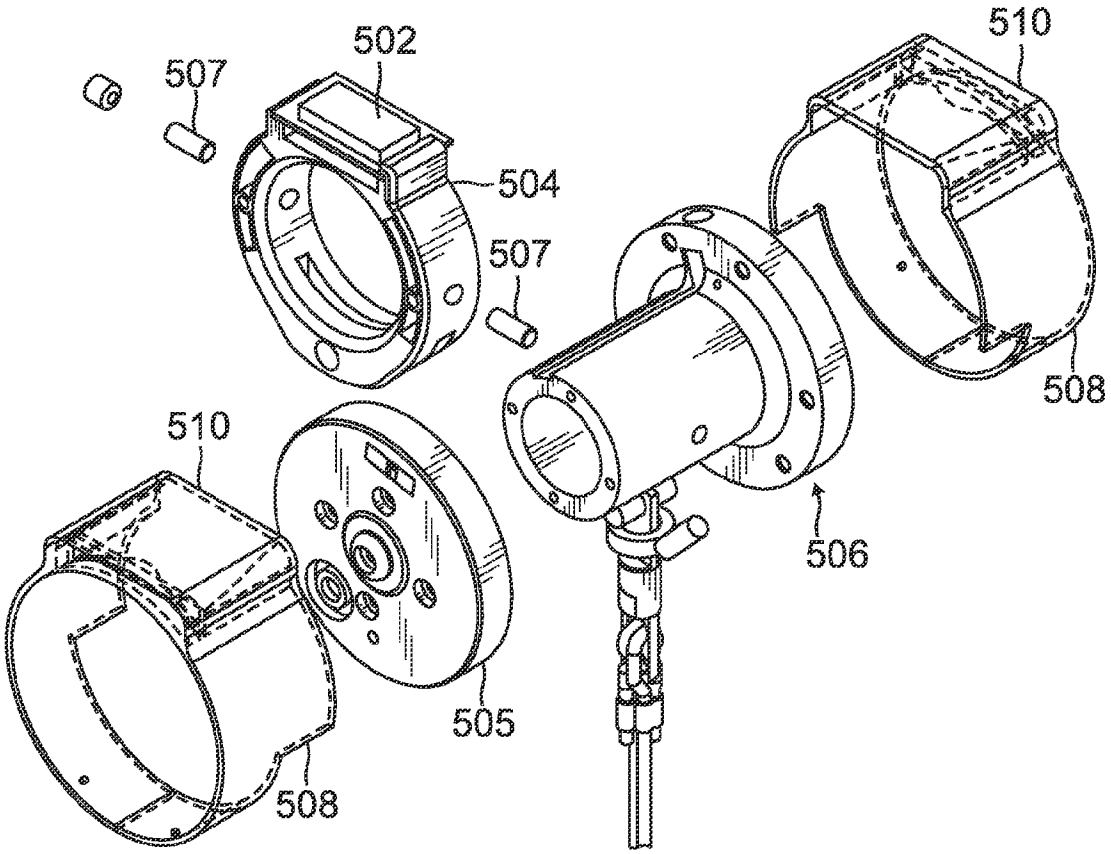
FIG. 14 is a partially exploded schematic depicting a drum core 506 for mounting a swivel 504 using pins 507, an end cap 505, and a cover 508.

Another related variation of the invention a golf apparatus 500 is provided substantially as shown in FIGS. 11-18, which includes a rotating optical drum 501, an elongated cord 601, a golf ball 702, a base member 801, a consol 902 and a frame structure 890. As shown in FIGS. 12A and 12B, within optical drum 501 is an optical sensor 502, which as shown in FIG. 14 is positioned along a swivel ring 504, which itself is positioned around and mounted to drum core 506 by pins 507 (also shown in FIG. 13), which permit swiveling of the swivel ring 504 in a direction that is perpendicular to the rotational direction of the optical drum 501.

Figure 15B:
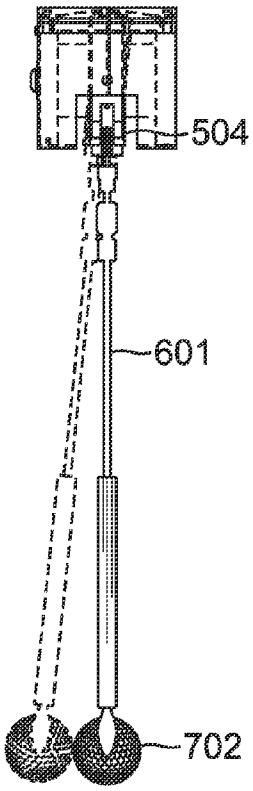
FIG. 15B is a schematic showing swivel of a ball 702 and elongated cord 601.
Figure 15A:
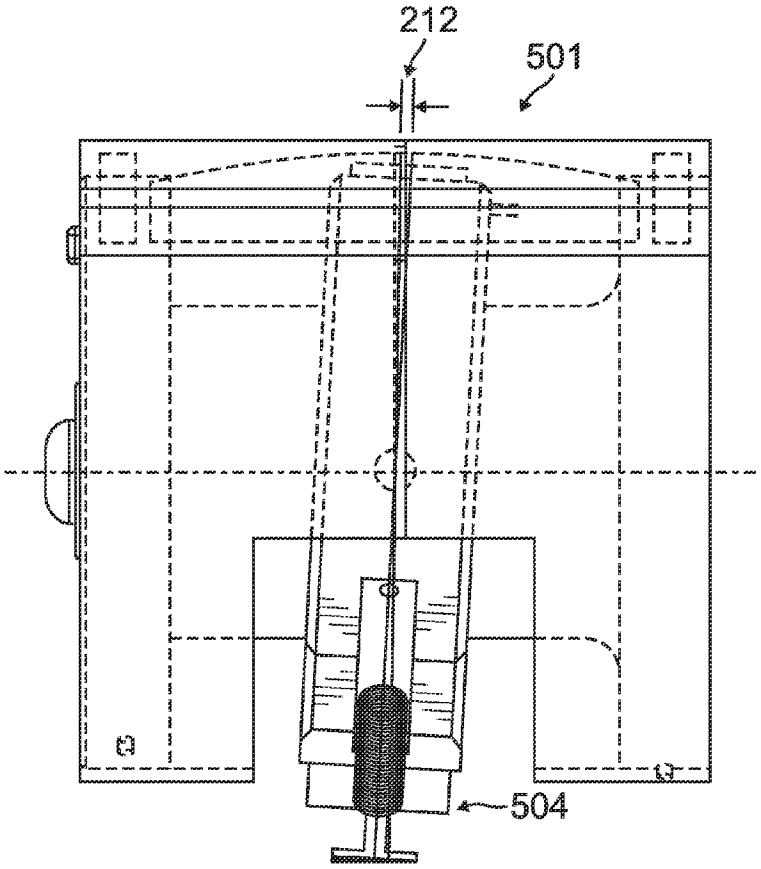
FIG. 15A is an elevational view of an optical drum 501 showing a swivel 504 that rotates a swivel distance 212.

As can be seen in FIGS. 15A and 15B, striking ball 702 with an open or closed club face causes ball 702 to move either left or right from a center path. Left or right movement of ball 702 is transferred through the elongated cord 601 causing swivel ring 504 to swivel either left or right in a direction opposite the ball 702 and along an arc path. Swiveling of the swivel ring 504 causes optical sensor 502 to rotationally swivel in combination with swivel ring 504. Turning back to FIG. 14, swiveling of optical sensor 502 occurs in relation to drum cover 508. Accordingly, by tracking movement across drum cover 508, such as along an arc path of a drum slot 510 optical sensor 502 is capable of detecting a swivel distance 212 as shown in FIG. 15A thereby permitting calculation of a swivel angle and thus a trajectory vector of a ball 702 that differs from the rotational direction of the drum 501. Accordingly, swivel angle can be used to calculate overall theoretical ball trajectory or the degree at which a club face is open or closed.

The skilled artisan will appreciate that as the optical drum 501 continues to rotate, the angle from center or the arc length will continue to lessen. As such, in a preferred embodiment, the maximum value corresponding to the maximum swivel angle or maximum off center ball trajectory is saved for display. This can be accomplished by measuring or recording the swivel that occurs during the initial rotation of the optical drum 501. In some embodiments, a swivel is measured during a second rotation. In other embodiments a swivel is measured during a third rotation. In still further embodiments, the swivel is measured during two or more complete rotations and averaged to provide an average angle or average degree off center value. The skilled artisan will appreciate swivel measurement or detection can be initiated upon detection of rotation of the drum 501, such as by incorporating a magnet sensor 110*a* that detects the passage of a rotating magnet 110*b* as shown in FIG. 2.

Optical sensor 502 may be formed in any suitable way, which permits optical sensor 502 to detect movement across drum cover 508. In preferred embodiments, drum cover 508 includes a slot 510 that accepts optical sensor 502. In preferred embodiments, optical sensor 502 includes a diode, such as a LED or laser diode to emit light against the inner surface of the drum cover 508. The optical sensor 502 also preferably includes a corresponding sensor means to detect the emitted light thereby detecting movement of the optical sensor 502 and thus permitting ball flight angle to be accurately determined.

In some embodiments the optical sensor 502 is an optoelectronic sensor that operates akin to a video camera that takes rapid sequential images of the inner surface of the drum cover 508 and using digital image correlation, detects naturally occurring texture variations in materials or detects changes in a printed surface across the drum cover 508 and thereby is able to determine or measure the amount of swivel of the optical sensor 502 across the drum cover 508. High speed camera imaging and digital image correlation is improving rapidly and thus such advances can easily be adapted into the optical drum 501. Further, these technologies can be adapted from a variety of optical mouse technologies used in the computer arts, which track movement of the mouse across a surface, such as a desk. In related embodiments the optical sensor 502 detects shifts in wavelength of an emitted light due to the swiveling of the optical sensor 502 along the inner surface of the optical drum 501. In preferred embodiments the inner surface is reflective to enhance reflection of the emitted light.

Figure 12A:
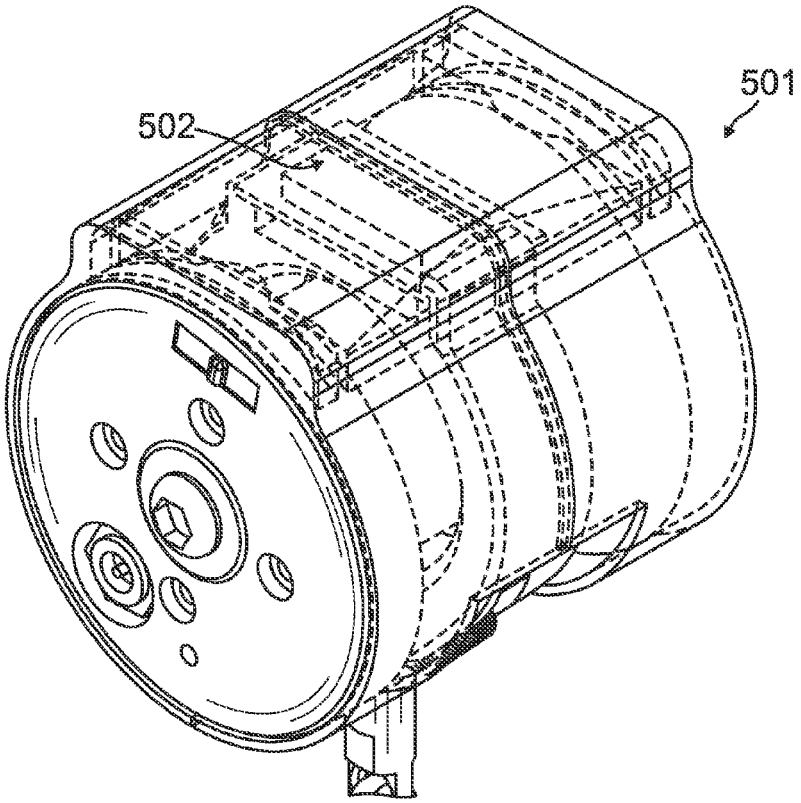
FIG. 12A is a perspective view of an optical drum 501 showing an inner optical sensor 502.
Figure 12B:
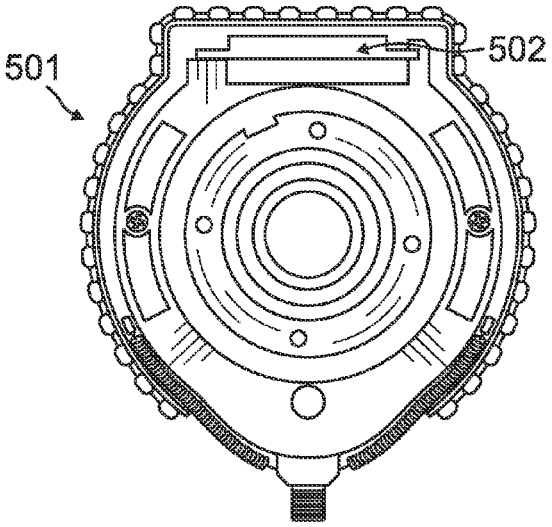
FIG. 12B is a cutaway view of an optical drum showing the optical sensor 502.
Figure 12C:
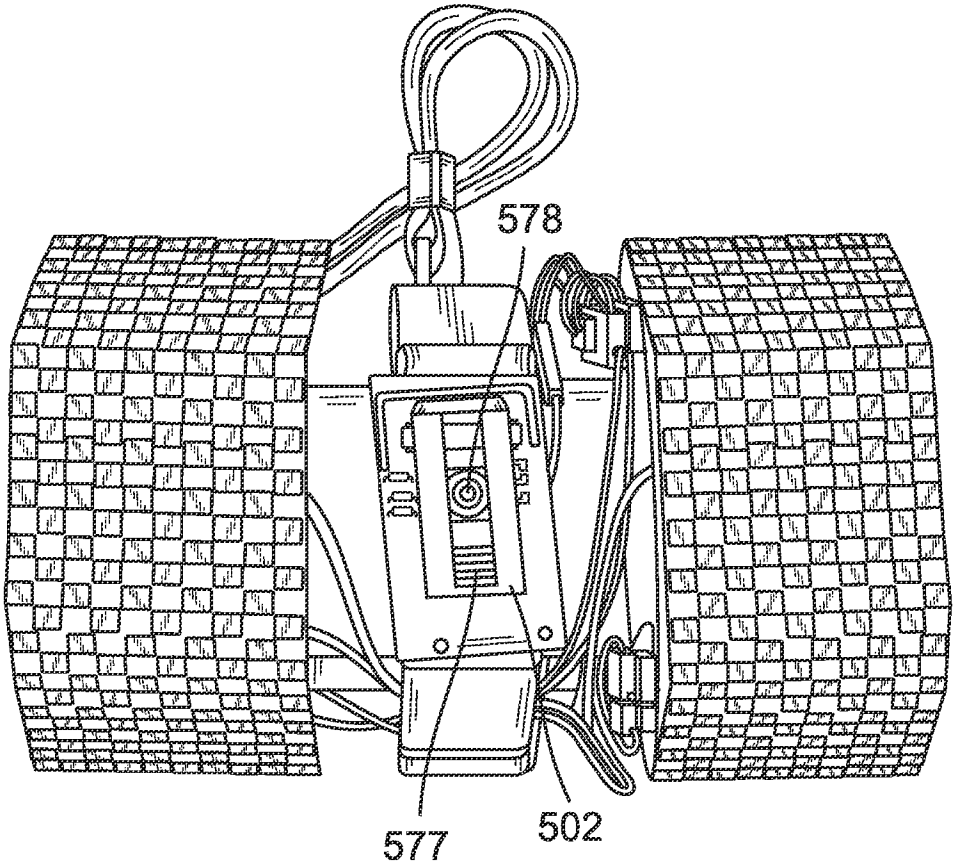
FIG. 12C is a partially exploded view showing the optical sensor 502.
Figure 12D:
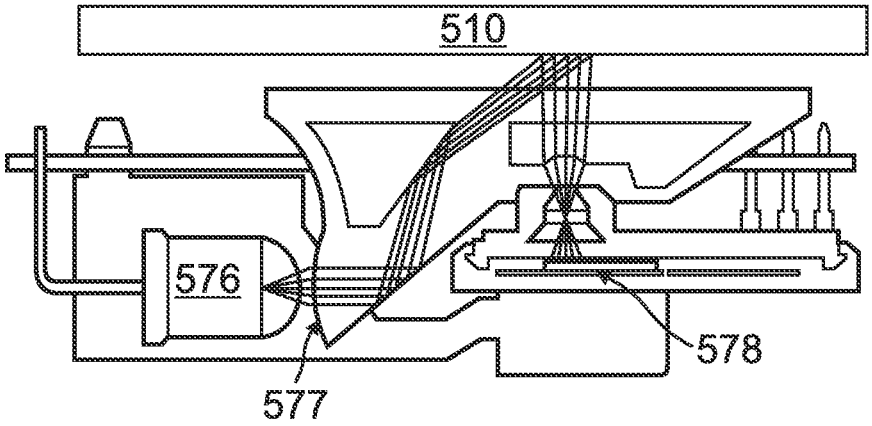
FIGS. 12D and 12E are schematics depicting operation of the optical sensor 502 against a reflective drum slot 510.
Figure 12E:
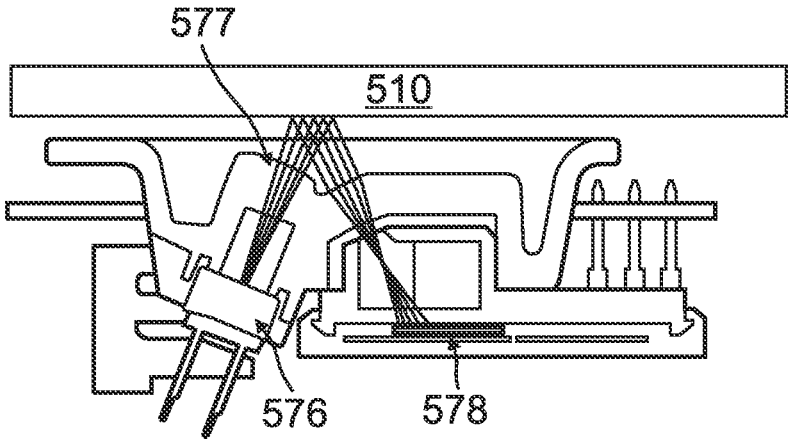
Figure 13:
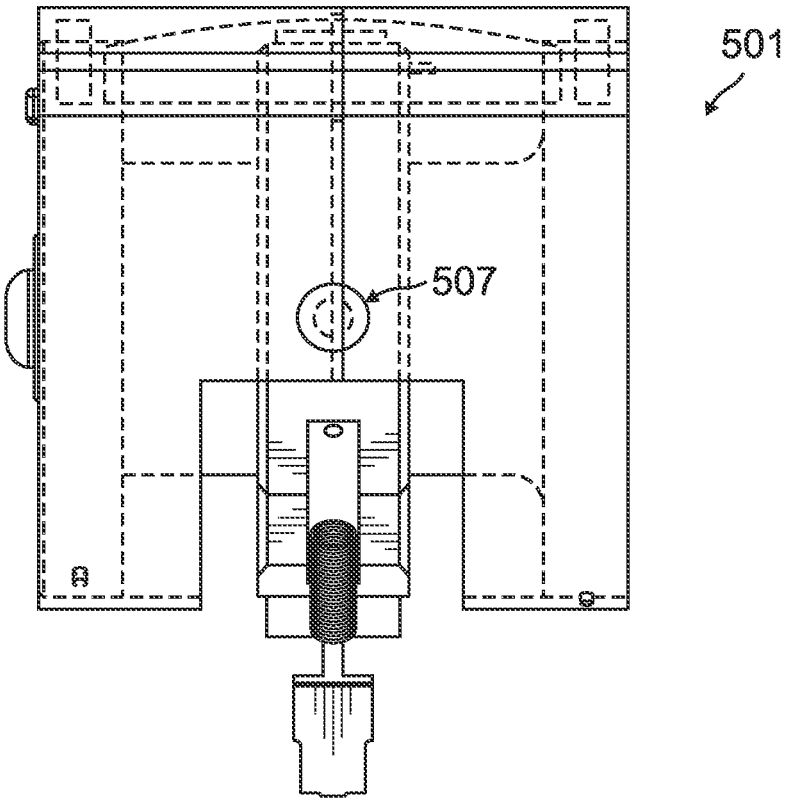
FIG. 13 is a front elevational view of an optical drum 501 showing pin 507 that guides rotation perpendicular to the rotational direction of the drum 501.

The skilled artisan will appreciate there are a number of variations to optical tracking methods and sensors, which can be used with the present invention. Preferred approaches are shown in FIGS. 12C through 12E, the optical sensor 502 preferably includes a small emitting light source 576, such as a LED, red in color. The LED emits light, preferably through a collimating lens 577, which then bounces or is reflected off a reflective surface, such as the slot 510 along the drum cover 508 and is detected by a complementary metal oxide semiconductor (CMOS) sensor 578. The CMOS sensor 578 sends each image reflected back to a digital signal processor (DSP) for analysis. Using thousands of images that the CMOS 578 sends to the DSP for analysis, the DSP is able to detect both patterns and images and can determine if the optical sensor has moved, at what distance it has moved and at what speed. The DSP can also determine coordinates that are then sent to the processor that the optical sensor 502 is hooked up to, such as within the drum 501 or preferably within the consol 902. Such technologies can be adapted from optical mouse technologies used in the computer arts.

There are many benefits to using an optical based system to determine ball trajectory. For example, the optical sensor 502 has no moving parts, which increases reliability. Measuring movement using an optical sensor also provides a high degree of precision with recent improvements in optical tracking technologies.

Figure 16:
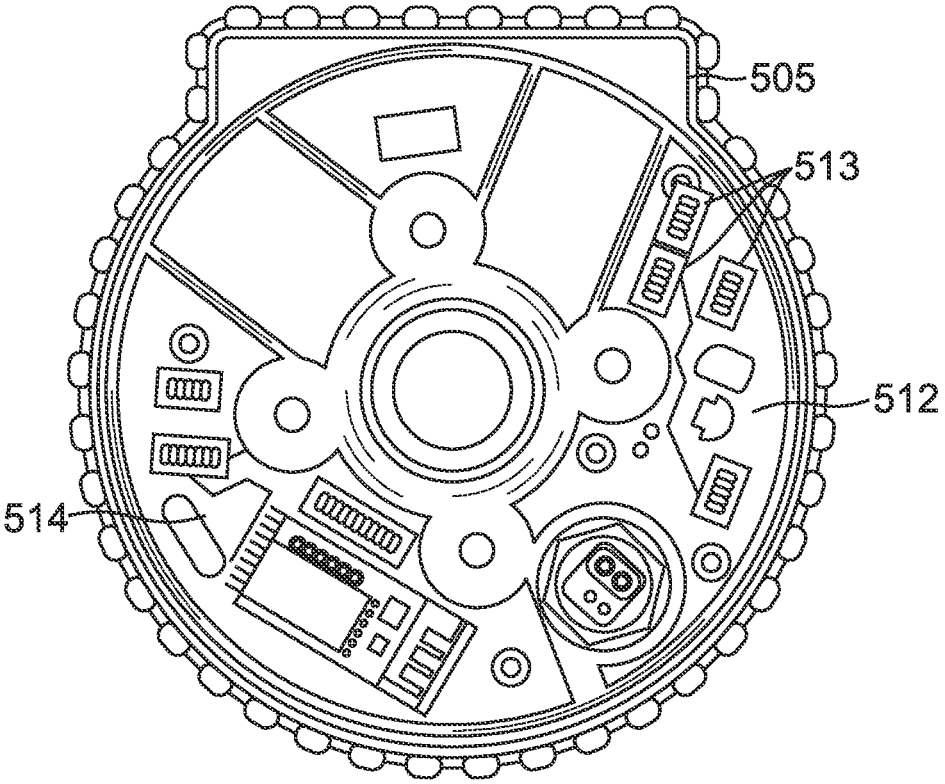
FIG. 16 is a cutaway view showing end cap 505 with drum circuitry 512.
Figure 17A:
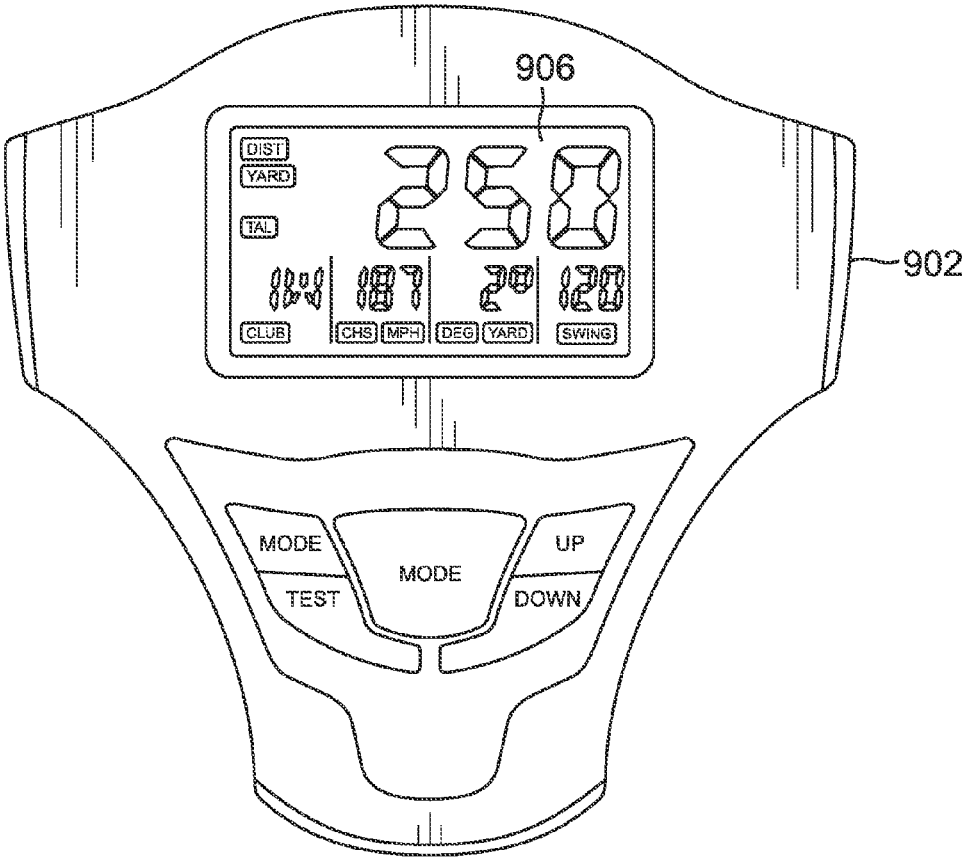
FIG. 17A is a front elevational view of a consol 902.
Figure 17B:
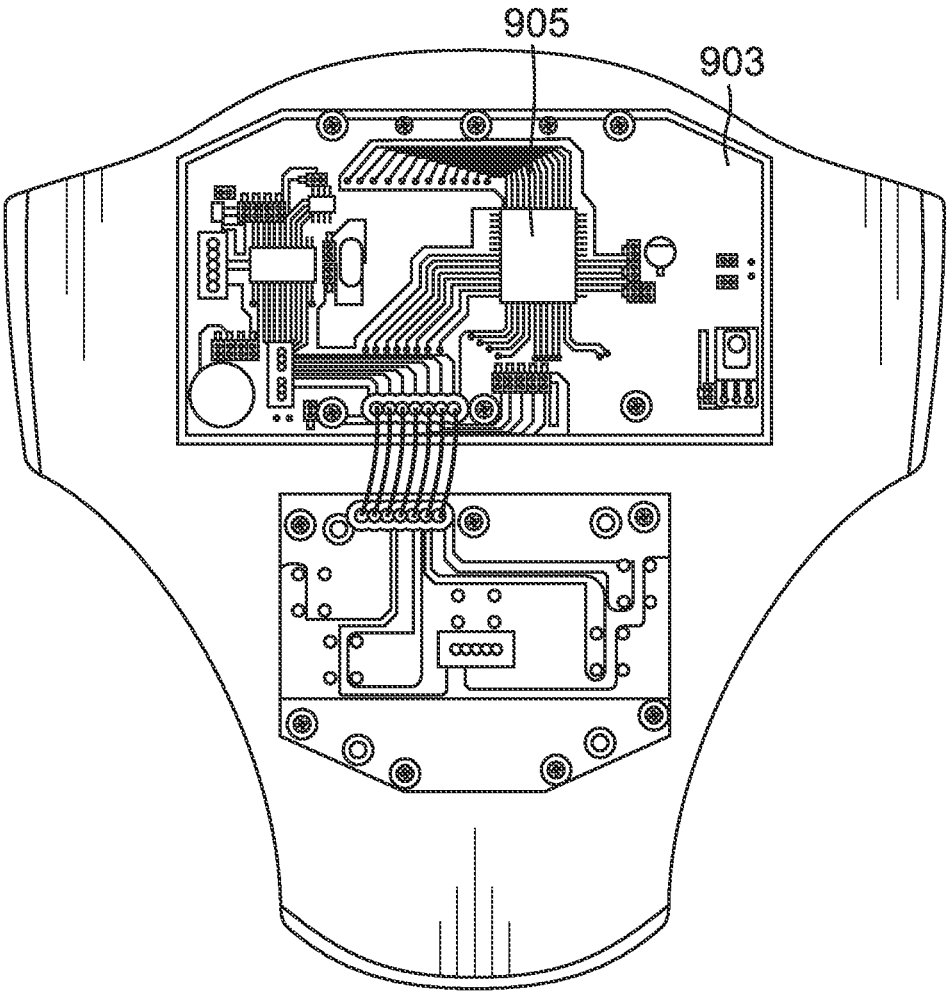
FIG. 17B is a cutaway rear view showing internal consol circuitry 903 including processor 905.
Figure 17D:
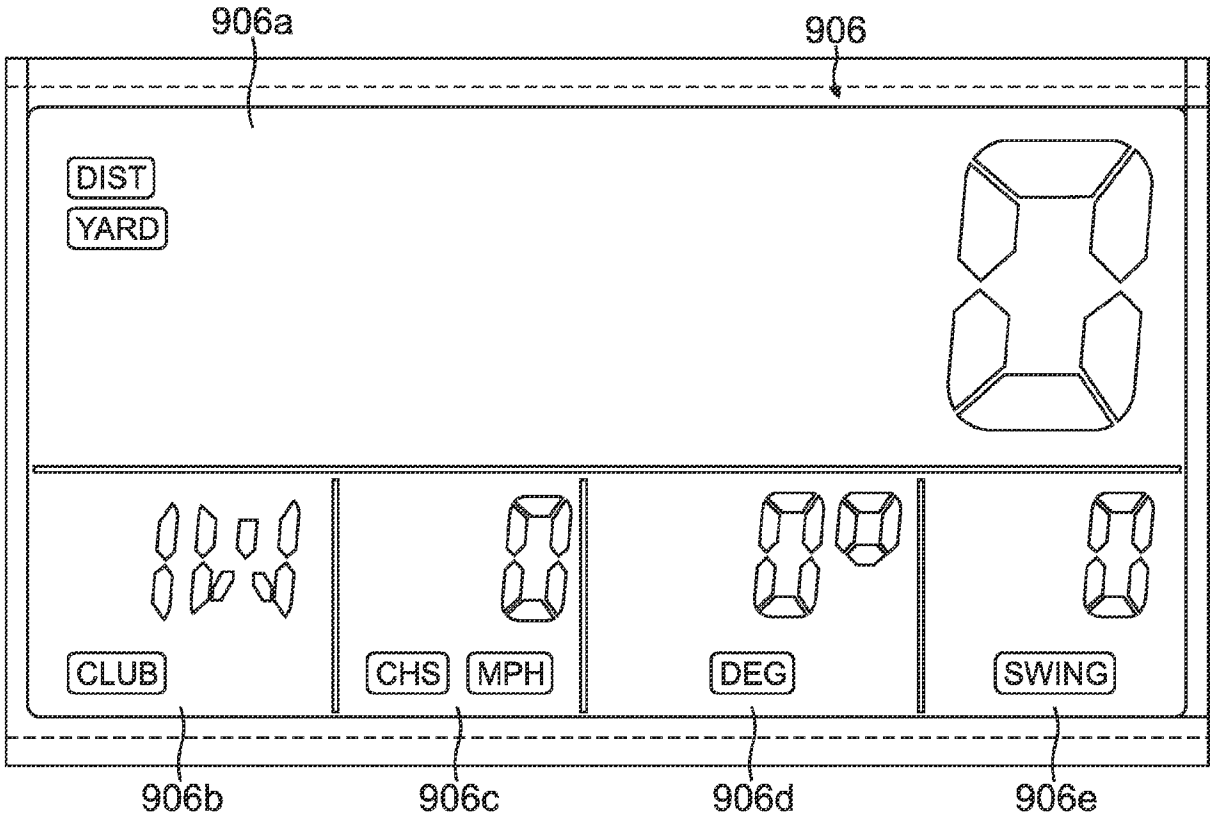
FIG. 17D shows a consol display screen 906.
Figure 18:
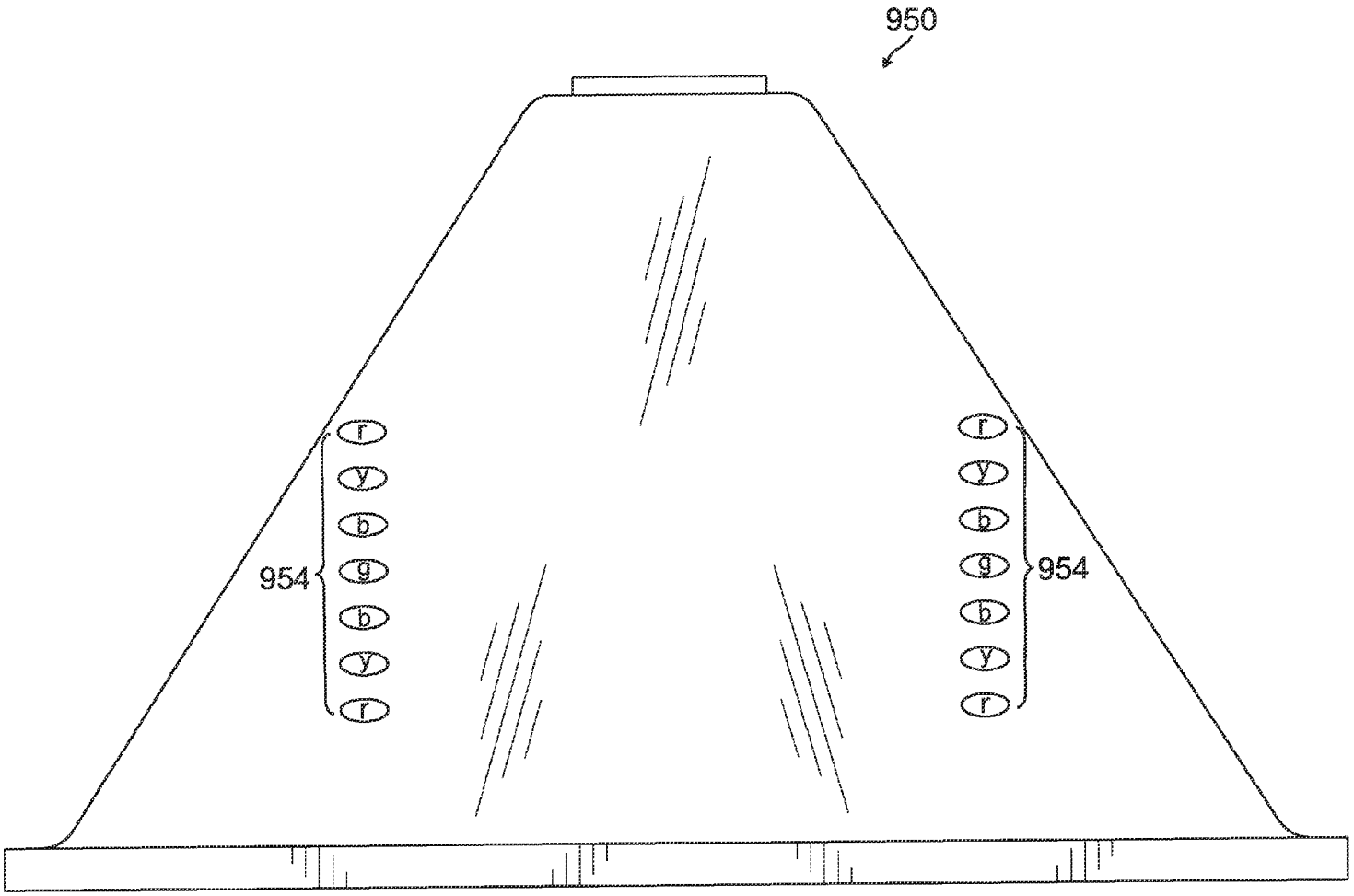
FIG. 18 is a front elevational view of an embodiment of a frame base 950 with LEDs 954.

As shown in FIG. 14, preferably the optical drum 501 also includes an end cap 505, which as shown in FIG. 16 may include drum circuitry, which itself includes a power source PCB 512 for supplying power to components within the drum 501 through power communication plugs 513, such as to a wireless data transmitter 514 such as Bluetooth or other data frequency transmitters, the optical sensor 502, and the like. The drum circuitry can also have a processor such as to process data from the optical sensor 502 or process rotational data, memory, batteries and the like. In some embodiments swing data can be stored in the drum 501 and downloaded to a remote computer for further analysis, data plotting in the form of graphs or the like using suitable software. In preferred embodiments trajectory data measured using the optical sensor 502 is transmitted wirelessly from the wireless data transmitter 514 to a consol 902, which as shown in FIGS. 17A-17C, can include consol circuitry 903 which can include a wireless receiver, a processor 905, memory, power supply, such as battery and the like. The skilled artisan will appreciate that since ultimately degree off center will be displayed using data from the optical sensor 502 such calculations can be performed by the drum circuitry if equipped with a suitable processor followed by transmission to the consol 902. Alternatively data can be transmitted by the wireless transmitter 514, received by the consol 902 and the consol can perform any needed trajectory calculations using the processor 905 within the consol circuitry 903. Such calculations can be performed using mathematical equations that consider the swivel angle, rotation speed, acceleration and direction, ball plane or the like as known in the computational arts. The skilled artisan will appreciate that the consol 902 can communicate with the drum 501, the magnet sensor 110*a*, the means for raising the impact area and the like to coordinate or instruct any needed operations and to make any needed calculations. As eluded to, consol 902 also includes a display screen 906, which depicts various readouts, such as ball flight distance 906*a*, club identifier 906*b*, club head speed (CHS) 906*c*, degree off center 906*d*, total number of swings per session 906*e* and the like. The skilled artisan will appreciate that the consol 902 may permit the user to switch across various programming modes, select user data or average data and the like for further statistical analysis. In addition, by loading course information into memory of the consol circuitry 903, such as distances, widths and like, which themselves can be modeled from global position satellite (gps) coordinates, the user can simulate playing any course. Accordingly, in some embodiments the display simulates a theoretical position on a simulated golf course, which can be updated with each swing by sequentially comparing or plotting ball vector information to a loaded map.

To further assist the user in recognizing the accuracy of ball strike, the frame base 950 may include a plurality of indicator lights, such as LED indicators 954, which visually signal the degree at which the ball trajectory is off center. Non-limiting ranges contemplated can be between 0.25 to 5 degrees per LED position with 0.5 to 2.5 being preferred and 1 degree being most preferred. For instance, if the user hits the ball 702 square, a center green LED pair 954*g* will illuminate and the console display screen 906 will display a plus or minus angle from 0-2 degrees in a degree off center data 906*d* field. If the user hits the ball right 3 degrees, the console display screen 906 will display 3 degrees in the degree off center 906*d* field and the blue LED 954*b* will illuminate. As a further example, if a right handed hitter hits the ball 4 degrees to the left, the console display screen 906, will display −4 degrees in the degree off center 906*d* data field and the yellow LED 954*y* will illuminate. The red LED 954*r* indicates anything over 5 degrees, or OB or out of bounds.

The skilled artisan will appreciate that a means of measuring the speed of rotation or acceleration of the optical drum 501, which can be used to measure club head speed or predict a corresponding ball distance, can be accomplished using a variety of approaches such as by securing a suitable magnet in the optical drum 501 and a magnet sensor secured to the frame structure. Alternatively gearing can be joined to the drum 501, such as on the drum core 506 to measure rotation or rotational speed. The skilled artisan will appreciate that rotational speed or acceleration can be converted to club head speed, a theoretical distance and when combined with vector information from the optical sensor 502 further detailed positioning can be determined such as distance from center of fairway, distance from pin, landing in virtual rough, sand trap, lake, hazard and the like. This theoretical spatial position can be calculated in consideration of vectors incorporating rotational speed and swivel angle and applying the results to a mapped course defined by Cartesian coordinates. Cartesian coordinates corresponding to a simulated golf course can be generated from gps coordinates of a known golf course as known in the computational arts. Thus, theoretical position can be compared with simulated course maps and the like.

Having described the invention in detail, it will be apparent that modifications, variations, and equivalent embodiments are possible without departing the scope of the invention defined in the appended claims.

What is claimed is:

1. A golf swing apparatus comprising:

(a) a rotating drum that houses a swivel and a sensor, wherein the swivel rotates in a direction perpendicular to the rotational direction of the drum and the sensor detects a change in swivel angle;

(b) an elongated cord comprising a proximal end secured to the swivel and a distal end secured to a golf ball;

(c) a base member having an impact layer over which a user may swing a golf club, wherein the impact layer is switchable between two orientations, the first orientation being planar to provide a flat surface for impacting a golf club during a golf swing and the second orientation being raised across a width of the impact layer and perpendicular to the rotational direction of the drum to stop or slow a rotating golf ball after impact;

(d) a frame structure holding the rotating drum in an elevated position above the impact layer and providing an axis for the rotational direction;

(e) a means for measuring rotation speed of the rotating drum in a form of a magnet that rotationally passes a magnet sensor or a light beam that rotationally passes a light detector; and (f) a processor operably connected to the sensor within the drum and the means for measuring rotation speed for generating swing data.

2. The golf swing apparatus of claim 1, wherein the sensor within the drum is an optical sensor that detects the change in swivel angle by detecting movement across an inner surface of the rotating drum.

3. The golf swing apparatus of claim 1, wherein the sensor within the drum is mounted to the swivel, further wherein the swivel is a ring mounted to a drum core.

4. The golf swing apparatus of claim 1, wherein data from the sensor within the drum is wirelessly transmitted to the processor.

5. The golf swing apparatus of claim 1, wherein the means for measuring the rotation speed is the magnet that rotationally passes the magnet sensor, which further comprises:

(a) the magnet secured to the rotating drum; and (b) the magnet sensor secured to the frame structure.

6. The golf swing apparatus of claim 1, wherein the processor determines an approximate angle at which the ball left the user's club head.

7. The golf swing apparatus of claim 1, wherein the processor computes a theoretical spatial location relative to a simulated fairway to which the golf ball would travel.

8. The golf swing apparatus of claim 1, wherein the processor determines one or more selected from the group consisting of distance, club head speed, and degree off center.

9. The golf swing apparatus of claim 1, wherein the processor transfers swing data to a display for viewing.

10. The golf swing apparatus of claim 1, further comprising a series of light emitting diodes (LEDs) that display predicted trajectory information by selectively lighting different LEDs according to swivel angle.

11. The golf swing apparatus according to claim 1, wherein the impact layer is layered over a bottom layer, further wherein switching between the orientations slides the impact layer relative to the bottom layer.

12. The golf swing practice apparatus according to claim 11, further comprising a motor coupled to cables for pulling the impact layer to the second orientation.

13. The golf swing apparatus according to claim 1, further comprising a motor coupled to a rotatable paddle that raises the impact layer to the second orientation.

14. The golf swing apparatus according to claim 13, wherein the impact layer is layered over a bottom layer, further wherein the paddle is recessed into the bottom layer when the impact layer is in the first orientation.

15. A base member for use in a golf swing apparatus, the base member comprising:

(a) an impact layer lying over a bottom layer, wherein the impact layer is switchable between two orientations, the first orientation being generally planar to provide a flat surface for impacting a golf club during a golf swing and the second orientation being raised across a width of the impact layer to stop or slow the golf ball after impact, further wherein the impact layer slides relative to the bottom layer when switching between the two orientations; and (b) a means for raising the impact layer from the first orientation to the second orientation, wherein the means for raising the impact layer comprises a motor coupled to a rotatable paddle that raises the impact layer to the second orientation wherein the paddle is recessed into the bottom layer when the impact layer is in the first orientation.

16. A base member for use in a golf swing apparatus, the base member comprising:

(a) an impact layer lying over a bottom layer, wherein the impact layer is switchable between two orientations, the first orientation being generally planar to provide a flat surface for impacting a golf club during a golf swing and the second orientation being raised across a width of the impact layer to stop or slow the golf ball after impact, further wherein the impact layer slides relative to the bottom layer when switching between the two orientations; and (b) a means for raising the impact layer from the first orientation to the second orientation, wherein the means for raising the impact layer comprises a motor coupled to cables for pulling the impact layer to the second orientation.

17. The base member of claim 16, further comprising springs for returning the impact layer from the second orientation to the first orientation.

* * * * *